US011509998B2

(12) United States Patent
Chen et al.

(10) Patent No.: US 11,509,998 B2
(45) Date of Patent: Nov. 22, 2022

(54) LINEAR DIFFERENTIAL MICROPHONE ARRAYS WITH STEERABLE BEAMFORMERS

(71) Applicant: Northwestern Polytechnical University, Shanxi (CN)

(72) Inventors: Jingdong Chen, Shanxi (CN); Jilu Jin, Shanxi (CN); Gongping Huang, Shanxi (CN); Xuehan Wang, Shanxi (CN)

(73) Assignee: Northwestern Polytechnical University, Shanxi (CN)

( * ) Notice: Subject to any disclaimer, the term of this patent is extended or adjusted under 35 U.S.C. 154(b) by 86 days.

(21) Appl. No.: 17/191,253

(22) Filed: Mar. 3, 2021

(65) Prior Publication Data

US 2022/0295175 A1 Sep. 15, 2022

(51) Int. Cl.

| | |
|---|---|
| ***H04R 1/40*** | (2006.01) |
| ***H04R 3/00*** | (2006.01) |
| ***G10L 21/0216*** | (2013.01) |

(52) U.S. Cl.

CPC ..... *H04R 1/406* (2013.01); *G10L 21/0216* (2013.01); *H04R 3/005* (2013.01); (Continued)

(58) Field of Classification Search

CPC .. H04R 1/406; H04R 3/005; H04R 2201/403; H04R 2430/21; G10L 21/0216; G10L 2021/02166

See application file for complete search history.

(56) References Cited

U.S. PATENT DOCUMENTS 8,184,801 B1 * 5/2012 Hamalainen ..... H04M 9/08 379/406.03
11,107,455 B1 * 8/2021 Huang ..... G10K 11/348
(Continued)

OTHER PUBLICATIONS

Chen, J., Benesty, J., and Pan, C. "On the design and implementation of linear differential microphone arrays", Dec. 2014, The Journal of the Acoustical Society of America vol. 136, Issue 6, pp. 3097-3113. (Year: 2014).*

(Continued)

*Primary Examiner* — Daniel R Sellers
(74) *Attorney, Agent, or Firm* — Zhong Law, LLC

(57) ABSTRACT

An $N^{th}$ order linear differential microphone array (LDMA) with a steerable beamformer may be constructed by specifying a target beampattern for the LDMA at a steering angle θ. An $N^{th}$ order polynomial associated with the target beampattern may then be generated. A relationship between the nulls of the polynomial and the steering angle θ is determined and then a value of one of the nulls is determined based on N−1 assigned values for the other nulls and the determined relationship between the nulls of the polynomial and the steering angle θ. The steerable beamformer may be generated based on the determined null value and the N−1 assigned null values. The N−1 assigned null values may be associated with the N−1 nulls of the polynomial that are of less than $N^{th}$ order and the determined null value may be associated with the null of the polynomial that is of $N^{th}$ order.

18 Claims, 15 Drawing Sheets

(52) U.S. Cl.
CPC ..... *G10L 2021/02166* (2013.01); *H04R 2201/403* (2013.01); *H04R 2430/21* (2013.01)

(56) References Cited

U.S. PATENT DOCUMENTS

2004/0252845 A1* 12/2004 Tashev ..... G01S 3/8034 381/56
2015/0163577 A1* 6/2015 Benesty ..... H04R 1/08 381/92

OTHER PUBLICATIONS

Zhao, X., Benesty, J., Huang G., and Chen J., "On a Particular Family of Differential Beamformers With Cardioid-Like and No-Null Patterns," Dec. 28, 2020, IEEE, IEEE Signal Processing Letters, vol. 28, pp. 140-144. (Year: 2020).*

* cited by examiner

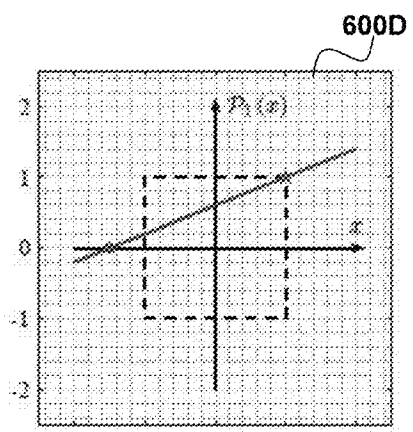
FIG. 6A
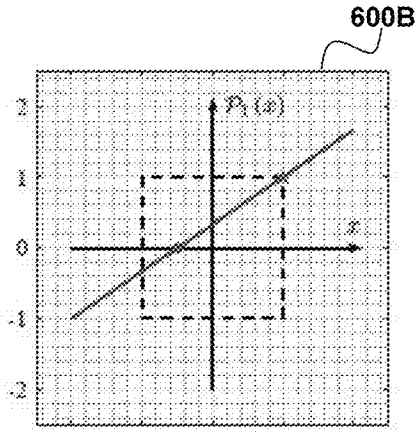
FIG. 6B
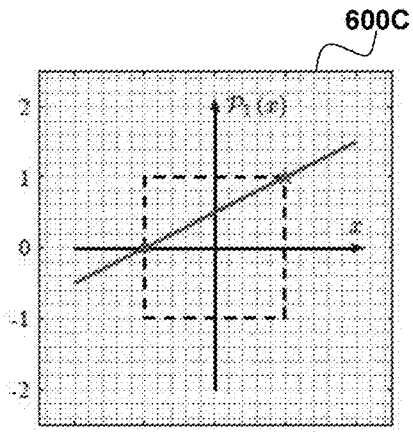
FIG. 6C
FIG. 6D
ideal functions * mainlobe * null
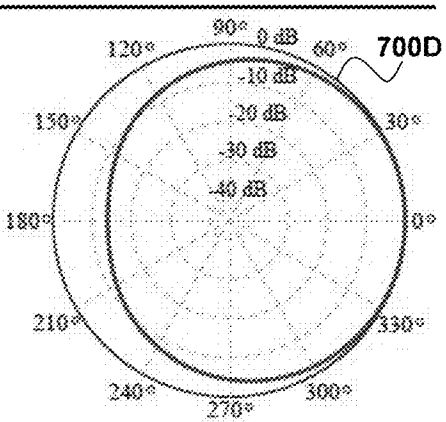
FIG. 7A
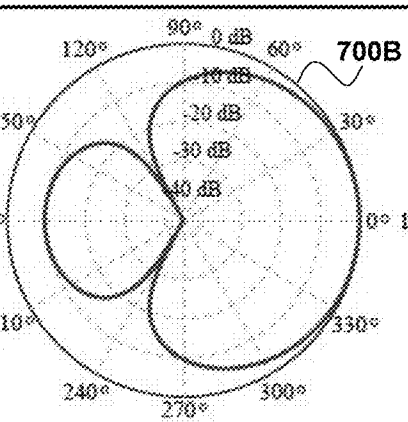
FIG. 7B
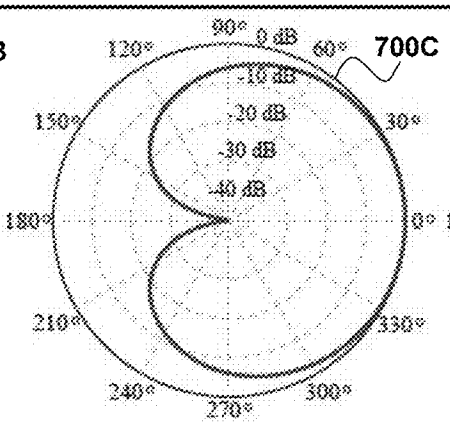
FIG. 7C
FIG. 7D ideal function * mainlobe * known nulls unknown null ideal function * mainlobe * known nulls unknown null ideal function * mainlobe ● known nulls ▒ unknown null

LINEAR DIFFERENTIAL MICROPHONE ARRAYS WITH STEERABLE BEAMFORMERS

TECHNICAL FIELD

This disclosure relates to differential microphone arrays and, in particular, to constructing higher order linear differential microphone arrays (LDMAs) with steerable differential beamformers.

BACKGROUND

A differential microphone array (DMA) uses signal processing techniques to obtain a directional response to a source sound signal based on differentials of pairs of the source signals received by microphones of the array. DMAs may contain an array of microphone sensors that are responsive to the spatial derivatives of the acoustic pressure field generated by the sound source. The microphones of the DMA may be arranged on a common planar platform according to the microphone array's geometry (e.g., linear, circular, or other array geometries).

The DMA may be communicatively coupled to a processing device (e.g., a digital signal processor (DSP) or a central processing unit (CPU)) that includes circuits programmed to implement a beamformer to calculate an estimate of the sound source. A beamformer is a spatial filter that uses the multiple versions of the sound signal captured by the microphones in the microphone array to identify the sound source according to certain optimization rules. A beampattern reflects the sensitivity of the beamformer to a plane wave impinging on the DMA from a particular angular direction. DMAs combined with proper beamforming algorithms have been widely used in speech based communication and human-machine interface systems to extract the speech signals of interest from unwanted signals, e.g., noise and interference.

BRIEF DESCRIPTION OF THE DRAWINGS

The present disclosure is illustrated by way of example implementations, and not by way of limitation, in the figures of the accompanying drawings described below.

FIGS. 6A-6D show graphs of polynomials associated with target beampatterns for a first order LDMA.

FIGS. 7A-7D show graphs of the associated target beampatterns for the first order LDMA.

DETAILED DESCRIPTION

Figure 1:
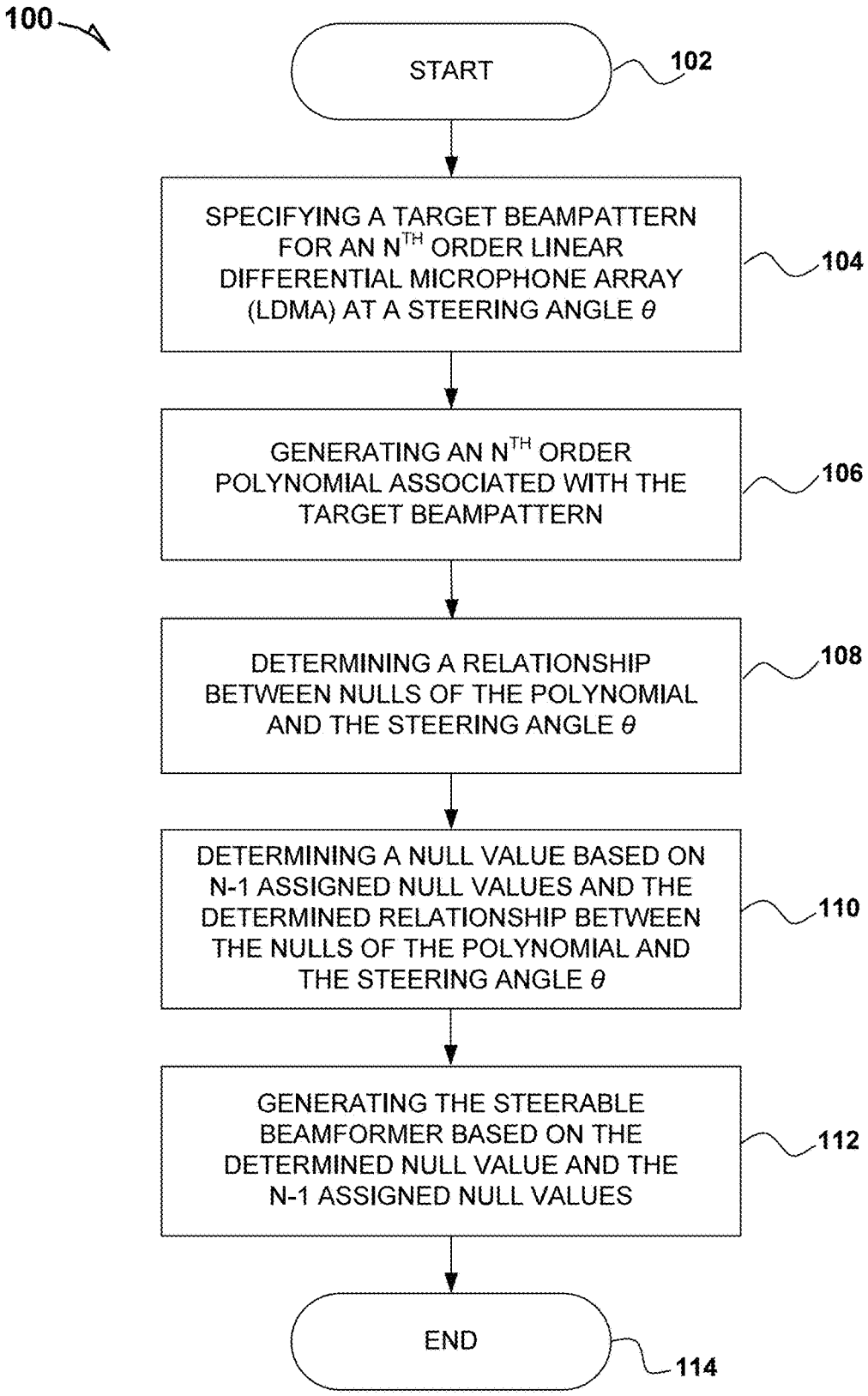
FIG. 1 shows a flow diagram illustrating a method for constructing an $N^{th}$ order linear differential microphone array (LDMA) with a steerable beamformer.

DMAs may measure the derivatives (at different orders) of the sound signals captured by each microphone, where the collection of the sound signals forms an acoustic field associated with the microphone arrays. For example, a first-order DMA beamformer, formed using the difference between a pair of microphones (either adjacent or non-adjacent), may measure the first-order derivative of the acoustic pressure field. A second-order DMA beamformer may be formed using the difference between a pair of two first-order differences of the first-order DMA. The second-order DMA may measure the second-order derivatives of the acoustic pressure field by using at least three microphones. Generally, an $N^{th}$ order DMA beamformer may measure the $N^{th}$ order derivatives of the acoustic pressure field by using at least N+1 microphones.

A beampattern of a DMA can be quantified in one aspect by the directivity factor (DF) which is the capacity of the beampattern to maximize the ratio of its sensitivity in the look direction to its averaged sensitivity over the whole space. The look direction is an impinging angle of the signal that comes from the desired sound source. The DF of a DMA beampattern may increase with the order of the DMA. However, a higher order DMA can be very sensitive to noise generated by the hardware elements of each microphone of the DMA itself, where the sensitivity is measured according to a white noise gain (WNG). The design of a beamformer for the DMA may focus on finding an optimal beamforming filter under some criteria (e.g., beampattern, DF, WNG, etc.) for a specified array geometry (e.g., linear, circular, square, etc.).

Linear differential microphone arrays (LDMAs) have been used in a wide range of applications for sound and speech signal acquisition. In some applications, such as hearing aids and Bluetooth headsets, the direction of the sound source may be assumed and beamformer steering is not really needed. However, in many other applications, such as smart televisions (TVs), smart phones, tablets, etc., a steerable beamformer may be desired as signals from the sound source position may not impinge along the endfire direction. For example, a LDMA may be mounted along the bottom side of a smart TV with voice recognition capabilities in order to form a beampattern along the broadside of the smart TV. Therefore, it would be useful to be able to steer the beamformer for such an LDMA in order to maximize signal acquisition (e.g., a user's voice commands) and noise reduction.

The present disclosure provides an approach to the design of LDMAs with steerable beamformers. The approach described herein includes defining a series of ideal polynomial functions to describe the ideal target beampatterns of applied LDMAs, e.g., in a smart TV. A fundamental condition for designing a steerable beamformer for an $N^{th}$ order LDMA may be determined based on a relationship between the nulls of the ideal polynomial function for the LDMA and a steering angle of the LDMA. A null of a polynomial (P(x)) is a variable value ($x_0$) that, when substituted in the polynomial ($P(x_0)$), the value of the polynomial is zero (i.e., ($P(x_0)=0$)). Values for the N−1 polynomial nulls of lowest order (e.g., order 1 to N−1) may be set according to the practical needs of the application (e.g., smart TV) and the value of the last null (e.g., $N^{th}$ order) may be determined based on the fundamental condition for the LDMA. The beamforming filter may then be generated by solving a linear system of equations constructed with the null constraints. Finally, experimental/simulation results (described below) demonstrate the beam steering achieved with LDMAs of $N^{th}$ order.

Methods

For simplicity of explanation, methods are depicted and described as a series of acts. However, acts in accordance with this disclosure can occur in various orders and/or concurrently, and with other acts not presented and described herein. Furthermore, not all presented acts may be required to implement the methods in accordance with the disclosed subject matter. In addition, the methods could alternatively be represented as a series of interrelated states via a state diagram or events. Additionally, it should be appreciated that the methods disclosed in this disclosure are capable of being stored on an article of manufacture to facilitate transporting and transferring such methods to computing devices. The term article of manufacture, as used herein, is intended to encompass a computer program accessible from any computer-readable device or storage media. In an implementation, the methods may be performed by a hardware processing associated with the LDMA 402 of FIG. 4.

FIG. 1 is a flow diagram illustrating a method 100 for constructing an $N^{th}$ order linear differential microphone array (LDMA) with a steerable beamformer, according to an implementation of the present disclosure. As described herein, the steerable beamformer refers to a beamformer that may be steered away from the endfire direction of the LDMA.

Referring to FIG. 1, at 102, a processing device may start executing operations to construct an $N^{th}$ order LDMA with a steerable beamformer, such as determining a signal model and suitable performance metrics.

Figure 4:
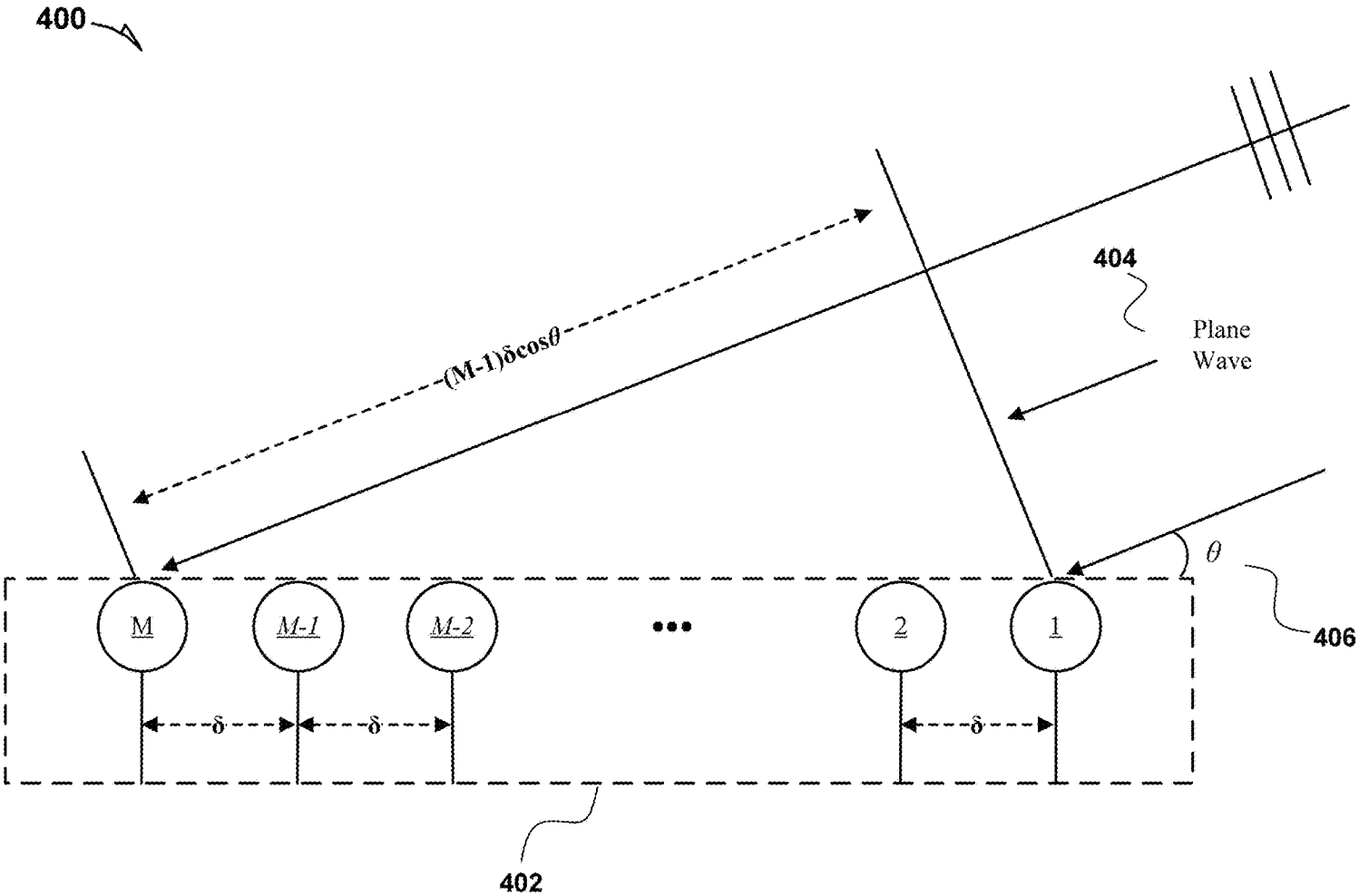
FIG. 4 shows an array geometry associated with the M microphones of an $N^{th}$ order LDMA arranged as a uniform LDMA.

In an implementation, a uniform LDMA composed of M omnidirectional microphones with a uniform inter-microphone spacing δ, may be used to capture a signal of interest, e.g., LDMA 402 of FIG. 4. Based on a plane wave (e.g., plane wave 404 of FIG. 4) that propagates in an anechoic acoustic environment at the speed of sound (i.e., c=340 m/s) and impinges on the LDMA at an angle parameterized by θ (e.g., angle 406 of FIG. 4), a corresponding steering vector (of length M) may be expressed as:

$$d(\omega,\cos\theta) \triangleq [1, e^{-j\overline{\omega}\cos\theta}, \ldots e^{-j(M-1)\overline{\omega}\cos\theta}]^T, \quad (1)$$

where j is the imaginary unit, with $j^2=-1$, $\overline{\omega}=\omega\delta/c$, with $\omega=2\pi f$ being the angular frequency and f>0 the temporal frequency, and the superscript T is the transpose operator. The acoustic wavelength is $\lambda=c/f$. In the design of LDMAs, it may be assumed that the spacing λ is much smaller than the smallest acoustic wavelength of the frequency band of interest. For example, in the simulations and experiments described below, a value of λ=1.0 cm is used for the spacing of the LDMA microphones (e.g., microphones 1–M=3 of FIGS. 8-10).

Considering the general case where the signal of interest (i.e., the desired signal) comes from the direction $\theta_s$, we can express the frequency-domain observation signal vector of length M as $$y(\omega) \triangleq [Y_1(\omega), Y_2(\omega) \ldots Y_m(\omega)]^T = d(\omega, \cos\theta_s)X(\omega) + v(\omega), \quad (2)$$

where X(ω) is the zero-mean source signal of interest and v(ω) is the zero-mean additive noise signal vector defined similarly to y(ω). The objective of beamforming is to design a spatial filter, h(ω), that may be applied to the observation signal vector (e.g., as expressed by (2) above) in order to obtain a good estimate of X(ω). The output of the beamformer may be expressed as:

$$Z(\omega)=h^H(\omega)y(\omega) \quad (3)$$

where the superscript H is the conjugate-transpose operator. In the design of LDMAs, a distortionless constraint in the desired direction (e.g., the look direction $\theta_s$) is generally desired, so that:

$$h^H(\omega)d(\omega,\cos\theta_s)=1. \quad (4)$$

In one implementation, the process of beamforming is to determine an optimal filter h(ω) subject to the distortionless constraint described in (4). The filter h(ω) may be evaluated using, for example, the following performance measures: beampattern, DF, and WNG.

As noted above, a beampattern describes the sensitivity of a beamformer to a plane wave impinging on the array from the direction θ. The beampattern may be defined as:

$$B_{\theta_s}[h(\omega),\theta] \triangleq h^H(\omega)d(\omega,\cos\theta) \quad (5)$$

The beampattern of a uniform LDMA (e.g., LDMA 402 of FIG. 4) is symmetric with respect to the linear endfire directions (e.g., 0° and 180°), so that:

$$B_{\theta_s}[h(\omega),\theta]=B_{\theta_s}[h(\omega),-\theta]. \tag{6}$$

With respect to "steerable" beamformers, the following three levels of steerability may be considered.

Fully steerable: at this level, for any given $\theta_s \in [0, 180°]$, $|B_{\theta s}[h(\omega), \theta_s]|^2=1$, $|B_{\theta s}[h(\omega), \theta]|^2 \leq 1$, and $B_{\theta s}[h(\omega), \theta]$ is a rotation of $B_0[h(\omega), \theta]$ by $\theta_s$.

Steerable: at this level, for any given $\theta_s \in [0, 180°]$, $|B_{\theta s}[h(\omega), \theta_s]|^2=1$, $|B_{\theta s}[h(\omega), \theta]|^2 \leq 1$, but $B_{\theta s}[h(\omega), \theta]$ varies with $\theta_s$ and is not a rotation of $B_0[h(\omega), \theta]$ by $\theta_s$. The present disclosure is concerned with this level of steerability for LDMAs.

Not steerable: at this level, for any given $\theta_s \in [0, 180°]$, $|B_{\theta s}[h(\omega), \theta_s]|^2=1$, but $|B_{\theta s}[h(\omega), \theta]|^2 \geq 1$ for some angles. Therefore, the corresponding beamformer may amplify noise and interference.

In this disclosure hereinafter, the subscript $\theta_s$ will be omitted from $B\theta_s$ $[h(\omega), \theta]$ in order to simplify the notation in some of the following equations.

As noted above, the WNG evaluates the sensitivity of a beamformer to some of the LDMA's own imperfections (e.g., noise from its own hardware elements). The WNG associated with an LDMA, as described above, may be written as:

$$W[h(\omega)] \triangleq \frac{|h^H(\omega)d(\omega, \cos\theta_s)|^2}{h^H(\omega)h(\omega)}. \tag{7}$$

The DF represents the ability of a beamformer in suppressing spatial noise from directions other than the look direction (e.g., other than 0°). The DF associated with the LDMA, as described above, may be written as:

$$D[h(\omega)] \triangleq \frac{|B[h(\omega), \theta_s]|^2}{\frac{1}{2}(\omega)\int_0^{\pi}|B[h(\omega), \theta]|^2 \sin\theta d\theta}, \tag{8}$$

Which may be rewritten as:

$$D[h(\omega)] = \frac{|h^H(\omega)d(\omega, \cos\theta_s)|^2}{h^H(\omega)\Gamma_d(\omega)h(\omega)}, \tag{9}$$

where $\Gamma_d(\omega)$ is a pseudo-coherence matrix (with M×M elements) of the noise signal in a diffuse (spherically isotropic) noise field. The $(i, j)^{th}$ element of $\Gamma_d(\omega)$ may be denoted as:

$$[\Gamma_d(\omega)]_{ij} = \frac{\sin\left[\frac{\omega(j-i)\delta}{c}\right]}{\frac{\omega(j-i)\delta}{c}}, \tag{10}$$

where ij=1, 2, . . . , M, and $[\Gamma_d(\omega)]_{ii}=1$.

At 104, the processing device may specify a target beampattern for the LDMA at a steering angle θ.

The ideal or target beampattern for an $N^{th}$ order DMA may be expressed as:

$$B_N(\theta)=\Sigma_{n=0}^{N} a_{N,n} \cos^n \theta=a_N^T p(\theta) \tag{11}$$

where $a_{N,n}$, n=0, 1, . . . N are real coefficients that determine the shape of the target beampattern for the DMA with:

$$a_N=[a_{N,0}\ a_{N,1} \ldots a_{N,N}]^T, \text{ and} \tag{12}$$

$$p(\theta)=[1\ \cos\theta \ldots \cos^N \theta]^T. \tag{13}$$

A differential beamformer may be designed for a DMA by optimizing the filter, h(ω), so that its beampattern is as close as possible to the target beampattern (11). Information about the nulls of the beampattern may be used to design the differential beamformer. Generally, an $N^{th}$ order DMA beampattern includes N nulls. Therefore, a straightforward way to design the filter, h(ω), is by determining the relationship between nulls of the beamformer beampattern and those of the ideal or target beampattern.

It may be assumed that the $N^{th}$ order DMA target beampattern has N distinct nulls at $\theta_1, \theta_2, \ldots, \theta_N$. Combining these null constraints with the distortionless constraint described above at (4), the following linear system of equations may be formed:

$$D(\omega,X_N)h(\omega)=i_1, \tag{14}$$

where $$x_N=[x_s\ x_1 \ldots x_N]^T, \tag{15}$$

with $x_s=\cos\theta_s$ and $x_n=\cos\theta_n$, n=1, 2, . . . , N, $$D(\omega, x_N) = \begin{bmatrix} d^H(\omega, x_s) \\ d^H(\omega, x_1) \\ \cdot \\ \cdot \\ \cdot \\ d^H(\omega, x_N) \end{bmatrix}, \tag{16}$$

and $i_1=[1\ 0 \bullet\bullet\bullet 0]^T$.

In order to design an $N^{th}$ order DMA, at least N+1 microphones are used. Based on the number of microphones being equal to N+1, the solution of (14) above may be expressed as:

$$h_E(\omega)=D^{-1}(\omega,x_N)i_1. \tag{17}$$

Based on the number of microphones being greater than N+1, the minimum norm solution of (14) may be derived as:

$$h_{MN}(\omega)=D^H(\omega,x_N)[D(\omega,x_N)D^H(\omega,x_N)]^{-1}i_1. \tag{18}$$

This solution yields an $N^{th}$ order DMA while improving the WNG, which increases with the number of microphones.

At 106, the processing device may generate an $N^{th}$ order polynomial associated with the target beampattern.

Taking x=cos θ, the target beampattern in (11) may be rewritten as an algebraic polynomial of order N with respect to x as:

$$P_N(x)=\Sigma_{n=0}^{N} a_{N,n} x^n. \tag{19}$$

Based on the $N^{th}$ order polynomial of (19) having N zeros, (19) may be rewritten as:

$$P_N(x) = \frac{1}{\xi_N}, \tag{20}$$

where $\xi_N=\Pi_{n=1}^{N}(x-x_n)$ is a normalization factor provided to satisfy the distortionless constraint in the desired look direction. Based on (19) and (20), it is evident that:

$$\frac{1}{\xi_N} = a_{N,N}. \tag{21}$$

Therefore, (20) may be rewritten as:

$$P_N(x)=a_{N,N}\,\Pi_{n=1}^{N}(x-x_n), \tag{22}$$

which may be referred to as the target polynomial, associated with the target beampattern in (11), throughout this disclosure.

At 108, the processing device may determine a relationship between nulls of the polynomial and the steering angle θ.

With respect to the association between the target polynomial and the target beampattern, it is clear that the steering vector (1) with respect to x is periodic:

$$d(\omega, x) = d(\omega, x + \frac{2k\pi}{\varpi}), \tag{23}$$

where k is an integer number and the period is $$\frac{c}{f\delta}.$$

Then, from (5) and (23), the beampattern is also periodic with respect to x:

$$B[h(\omega), x] = B\left[h(\omega), x + \frac{c}{f\delta}\right]. \tag{24}$$

Based on c>>fδ, only the part of the beampattern in the interval $-1 \le x \le 1$ may be seen and may be responsible for acquiring the signal of interest (e.g., a speech signal). Therefore, for target polynomials, a "visible zone" may be defined by the boundary conditions of $x=\pm 1$ and $P_N(x)=\pm 1$. The portion of the target polynomial inside the visible zone corresponds to the target beampattern $B_N(\theta)$ in the range $0 \le \theta \le \pi$.

Based on N=1, the first-order target polynomial may be expressed as:

$$P_1(x)=a_{1,1}\,x+a_{1,0}, \tag{25}$$

with $a_{1,1} \neq 0$, which is a linear function of x. Furthermore, based on the main lobe direction for the LDMA is set to an endfire direction, e.g., θs=0°, then $P_1(1)=1$. Therefore, $P_1(x)$ may be uniquely determined by the single null at $x_1$ as illustrated via the following four scenarios.

First-order dipole: $x_1=0$, and $a_{1,1}=1$, $a_{1,0}=0$.

First-order hypercardioid: $x_1=-1/2$, and $a_{1,1}=2/3$, $a_{1,0}=1/3$.

First-order cardioid: $x_1=-1$, and $a_{1,1}=1/2$, $a_{1,0}=1/2$

First-order subcardioid: $x_1=-3/2$, and $a_{1,1}=2/5$, $a_{1,0}=3/5$.

As described below with respect to FIGS. 6A-6D and 7A-7D (which plot target polynomials and associated target beampatterns) an invisible null (e.g., not located within the "visible zone") should not be neglected since it may be used in the design of LDMAs as shown in FIGS. 6D and 7D.

For higher order LDMAs (e.g., N≥2), based on the beam steering being focused on the range $-1 \le x \le 1$ and based on:

$$\frac{dP_N(x)}{d\theta} = -\sqrt{1-x^2} \times \frac{dP_N(x)}{dx}, \tag{26}$$

the derivative of the target polynomial of $P_N(x)$ with respect to x may be considered.

The target polynomial for N=2 may be expressed as:

$$P_2(x)=a_{2,2}\,x^2+a_{2,1}x+a_{2,0}, \tag{27}$$

and its derivative with respect to x is:

$$\frac{dP_2(x)}{dx} = 2a_{2,2}x + a_{2,1}. \tag{28}$$

Based on $P_2(x_s)$ being a maximum, then:

$$x_s = \frac{-a_{2,1}}{2a_{2,2}}. \tag{29}$$

Based on $-1<x_s<1$, $P_2$ (x) corresponds to the target beampattern of a second order LDMA, e.g., N=2. Therefore, in order to achieve the main lobe steering, null constraints may be set for the target polynomial. In the case of a second order LDMA, the steering direction, $x_s$, and the values of the nulls, $x_1$ and $x_2$, must satisfy certain conditions, e.g., a relationship between the nulls of the $N^{th}$ order polynomial (N=2) and the steering angle θs may be determined.

Based on (22), the second order target polynomial may be expressed as:

$$P_2(x)=a_{2,2}\,x^2-a_{2,2}(x_1+x_2)x+a_{2,2}\,x_1\,x_2. \tag{30}$$

Based on (27) and (30), then:

$$x_1 + x_2 = -\frac{a_{2,1}}{a_{2,2}}. \tag{31}$$

Substituting (31) into (29), the relationship among $x_s$, $x_1$, and $x_2$ (e.g., relationship between nulls of the polynomial and the steering angle $x_s$) may be expressed as:

$$x_1+x_2=2x_s, \tag{32}$$

which may be referred to as the fundamental condition for designing steerable beamformers for second order LDMAs.

The target polynomial for N=3 may be expressed as:

$$P_3(x)=a_{3,3}\,x^3+a_{3,2}\,x^2+a_{3,1}x+a_{3,0}, \tag{33}$$

and its derivative with respect to x is:

$$\frac{dP_3(x)}{dx} = 3a_{3,3}x^2 + 2a_{3,2}x + a_{3,1}. \tag{34}$$

Based on the derivative of P3 (x) at xs be equal to 0:

$$3x_s^2 + 2\frac{a_{3,2}}{a_{3,3}} + \frac{a_{3,1}}{a_{3,3}} = 0. \tag{35}$$

Based on (22) and (33), then:

$$\frac{a_{3,2}}{a_{3,3}} = -x_1 - x_2 - x_3, \text{ and} \tag{36}$$

$$\frac{a_{3,1}}{a_{3,3}} = x_1x_2 + x_1x_3 - x_2x_3. \tag{37}$$

Substituting (36) and (37) into (35), the relationship among xs, xi, x2 and X3 (e.g., relationship between nulls of the target polynomial and the steering angle xs) may be expressed as:

$$3x_s^2-2\Sigma_{n=1}^{3} x_n x_s+x_1x_2+x_2x_3-x_1x_3=0. \quad (38)$$

Therefore, for a target polynomial of $N^{th}$ order, the derivative with respect to x may be expressed as:

$$\frac{dP_N(x)}{dx} = \frac{1}{a_{N,N}}\sum_{n=1}^{N} na_{N,n}x_s^{n-1}. \quad (39)$$

Based on an expansion of (20):

$$P_N(x)=a_{N,N}\,\Sigma_{n=1}^{N}(-1)^{N-n}\,\zeta_{N,n}\,x^n. \quad (40)$$

where:

$$\zeta_{N,N} = 1, \quad (41)$$

$$\zeta_{N,N-1} = x_1 + x_2 + \ldots + x_N, \quad (42)$$

$$\zeta_{N,N-2} = x_1x_2 + x_1x_3 + \ldots + x_{N-1}x_N, \quad (43)$$

$$\ldots$$

$$\zeta_{N,1} = x_1x_2 \ldots x_{N-1} + \ldots + x_2x_3 \ldots x_N, \text{ and} \quad (44)$$

$$\zeta_{N,1} = x_1x_2 \ldots x_{N-1}x_N. \quad (45)$$

Based on (19) and (40), then:

$$\zeta_{N,n}(-1)^{N-n} = \frac{a_{N,n}}{a_{N,N}}. \quad (46)$$

where n=0, 1, . . . , N. Substituting (46) into (39), the fundamental condition for constructing an $N^{th}$ order LDMA with a steerable beamformer (e.g., relationship between nulls of the target polynomial and the steering angle $x_s$) may be expressed as:

$$\Sigma_{n=1}^{N} n(-1)^{N-n}\,\zeta_{n,n}\,x_s^{n-1}=0. \quad (47)$$

At 110, the processing device may determine a null value based on N−1 assigned null values and the determined relationship between the nulls of the polynomial and the steering angle θ.

In order to determine the nulls of the target polynomial for a given steering direction ($x_s$) of a steerable $N^{th}$ order LDMA, the first N−1 nulls may be assigned according to requirements of the practical application (e.g., smart TV), and then the last null may be determined based on the condition in (47) being satisfied. As described below with respect to FIG. 2, the N nulls may be arranged in an ascending order so that the last null is the $N^{th}$ order null.

Based on $x_s$=0, i.e., θs=90°, (clearly, $x_n \neq 0$, for n=1, 2, . . . , N), the fundamental condition of (47) may be rewritten as $$\zeta_{N,1}=0. \quad (48)$$

Based on the definition of ζN,1, the unknown null to control steering for the Nth order LDMA may be expressed as:

$$x_N = \frac{-1}{\sum_{n=1}^{N}\frac{1}{x_n}}. \quad (49)$$

Based on $x_s \neq 0$, the following vector may be defined:

$$a_N(x)=[1\ x \ldots x^N]^T, \quad (50)$$

where $x \in \{x_s, x_1, x_2, \ldots, x_N\}$. The derivative of the target polynomial at $x_s$ may be set to 0 so that:

$$q_N^T(x_s)\Sigma_N=0, \quad (51)$$

with diag (0, 1, . . . , N). The coefficients vector, $a_N$, defined in (12) may be derived from a linear system of equations:

$$Q(x)a_N=i_1, \quad (52)$$

where:

$$Q(x) = \begin{bmatrix} q_N^T(x_s) \\ q_N^T(x_s)\sum_N \\ q_N^T(x_1) \\ \vdots \\ q_N^T(x_{N-1}) \end{bmatrix}. \quad (53)$$

In the particular case where $x_n$ is set as a null of multiplicity P, we need to construct Q(x) may be constructed as:

$$Q(x) = \begin{bmatrix} q_N^T(x_s) \\ q_N^T(x_s)\sum_N \\ q_N^T(x_1) \\ \vdots \\ q_N^T(x_n) \\ q_N^T(x_n)\sum_N \\ \vdots \\ q_N^T(x_n)\sum_N^{P-1} \\ q_N^T(x_{n+P}) \\ \vdots \\ q_N^T(x_{N-1}) \end{bmatrix}. \quad (54)$$

The solution of $a_N$ may be expressed as:

$$a_N=Q^{-1}(x)i_1. \quad (55)$$

Based on the last two elements of $a_N$ being $a_{N,N-1}$ and $a_{N,N}$, then the last null, $x_N$, may be determined from the definition of $\zeta_{N-1,N}$ in (46) and (42) as:

$$x_N = \frac{a_{N,N-1}}{a_{N,N}} - \sum_{n=1}^{N} x_n. \quad (56)$$

As a result, the vector $x_N$ may be obtained according to (15).

At 112, the processing device may generate the steerable beamformer based on the determined null value and the N−1 assigned null values.

Finally, by substituting the determined null vector, $x_N$, into the linear system in (14) and solving for the optimal filter h(ω) by (17) or (18), the beamforming filters for steerable $N^{th}$ order LDMAs may be generated.

At 114, the processing device may end the execution of operations to construct an $N^{th}$ order LDMA with a steerable beamformer.

Figure 2:
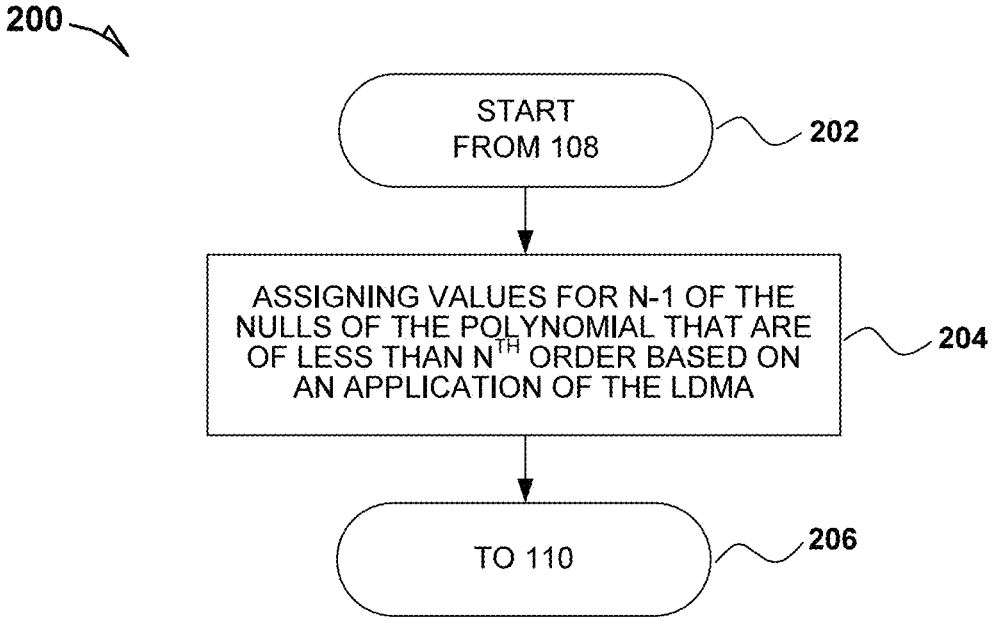
FIG. 2 shows a flow diagram illustrating a method for constructing an $N^{th}$ order LDMA with a steerable beamformer based on an application of the LDMA.

FIG. 2 shows a flow diagram illustrating a method 200 for constructing an $N^{th}$ order LDMA with a steerable beamformer based on an application of the LDMA, according to an implementation of the present disclosure.

Referring to FIG. 2, at 202, a processing device may start executing operations to construct an $N^{th}$ order LDMA with a steerable beamformer based on an application of the LDMA.

As noted above, with respect to FIG. 1, in order to determine the nulls of the target polynomial for a given steering direction ($x_s$) of a steerable $N^{th}$ order LDMA, values for the first N−1 nulls may be assigned and then the last null may be determined based on the condition in (47) being satisfied. Method 200 may continue from 108 of method 100 of FIG. 1.

At 204, values for the N−1 nulls of the target polynomial that are of less than $N^{th}$ order may be assigned based on the requirements of a practical application of the LDMA (e.g., a voice operated device).

As noted above, the first N−1 nulls may be the nulls of lower order (e.g., order 1 to order N−1) and the last unknown null to control the steering of the LDMA may be the highest order null (e.g., $N^{th}$ order) may be according to (56).

At 206, the processing device may end the execution of operations to to construct an $N^{th}$ order LDMA with a steerable beamformer based on an application of the LDMA.

Method 200 may continue to 110 of method 100 of FIG. 1.

Figure 3:
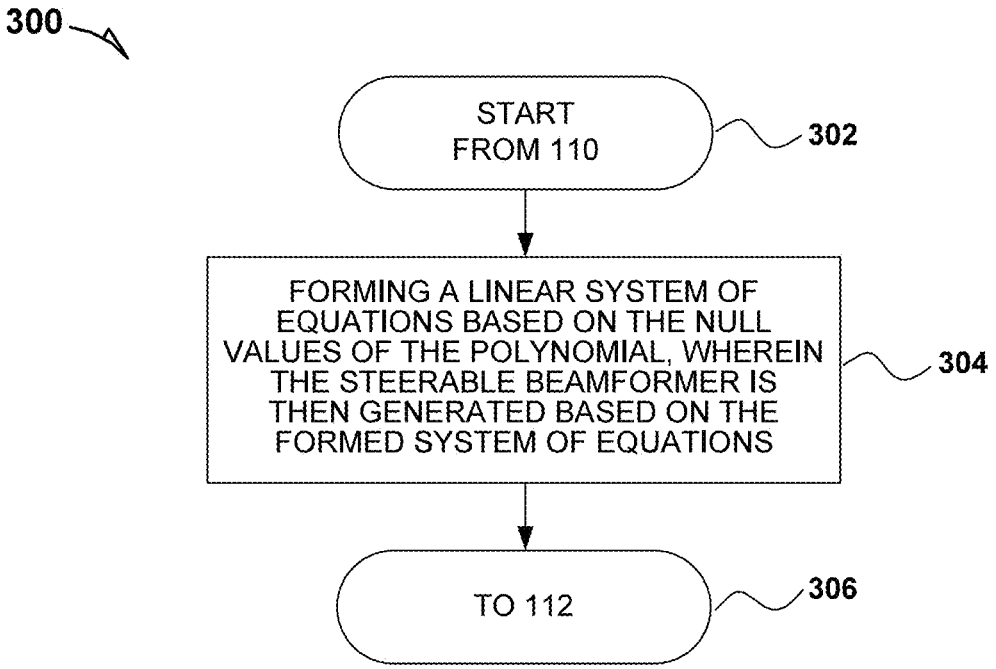
FIG. 3 shows a flow diagram illustrating a method for constructing an $N^{th}$ order LDMA with a steerable beamformer based on a linear system of equations.

FIG. 3 shows a flow diagram illustrating a method 300 for constructing an $N^{th}$ order LDMA with a steerable beamformer based on a linear system of equations, according to an implementation of the present disclosure.

Referring to FIG. 3, at 302, a processing device may start executing operations to construct an $N^{th}$ order LDMA with a steerable beamformer based on a linear system of equations.

At 304, a system of linear equations may be formed based on the null values/constraints of the target polynomial.

As noted above, with respect to FIG. 1, substituting the determined null vector, $x_N$ of (57), into the linear system in (14) and solving for the optimal filter $h(\omega)$ according to (17) or (18), the beamforming filters for steerable $N^{th}$ order LDMAs may be generated.

At 306, the processing device may end the execution of operations to construct an $N^{th}$ order LDMA with a steerable beamformer based on a linear system of equations.

Method 300 may continue to 112 of method 100 of FIG. 1.

System

FIG. 4 shows an array geometry 400 associated with the M microphones of an $N^{th}$ order LDMA 402 arranged as a uniform LDMA, according to an implementation of the present disclosure.

LDMA 402 may include M omnidirectional microphones, with a uniform inter-microphone spacing δ, that may be used to capture a signal of interest. A plane wave 404 may propagate in an anechoic acoustic environment at the speed of sound (i.e., c=340 m/s) and impinge on the LDMA 402 at an incidence azimuth angle parameterized by θ 406. It may be assumed that the maximum distance between any two adjacent microphones (e.g., $\delta_{max}$) will be smaller than the wavelength λ of impinging plane wave 404.

As noted above, with respect to FIG. 1, a beampattern describes the sensitivity of a beamformer to plane wave 404 impinging on the LDMA 402 from the direction θ 406.

Use Case

Figure 5:
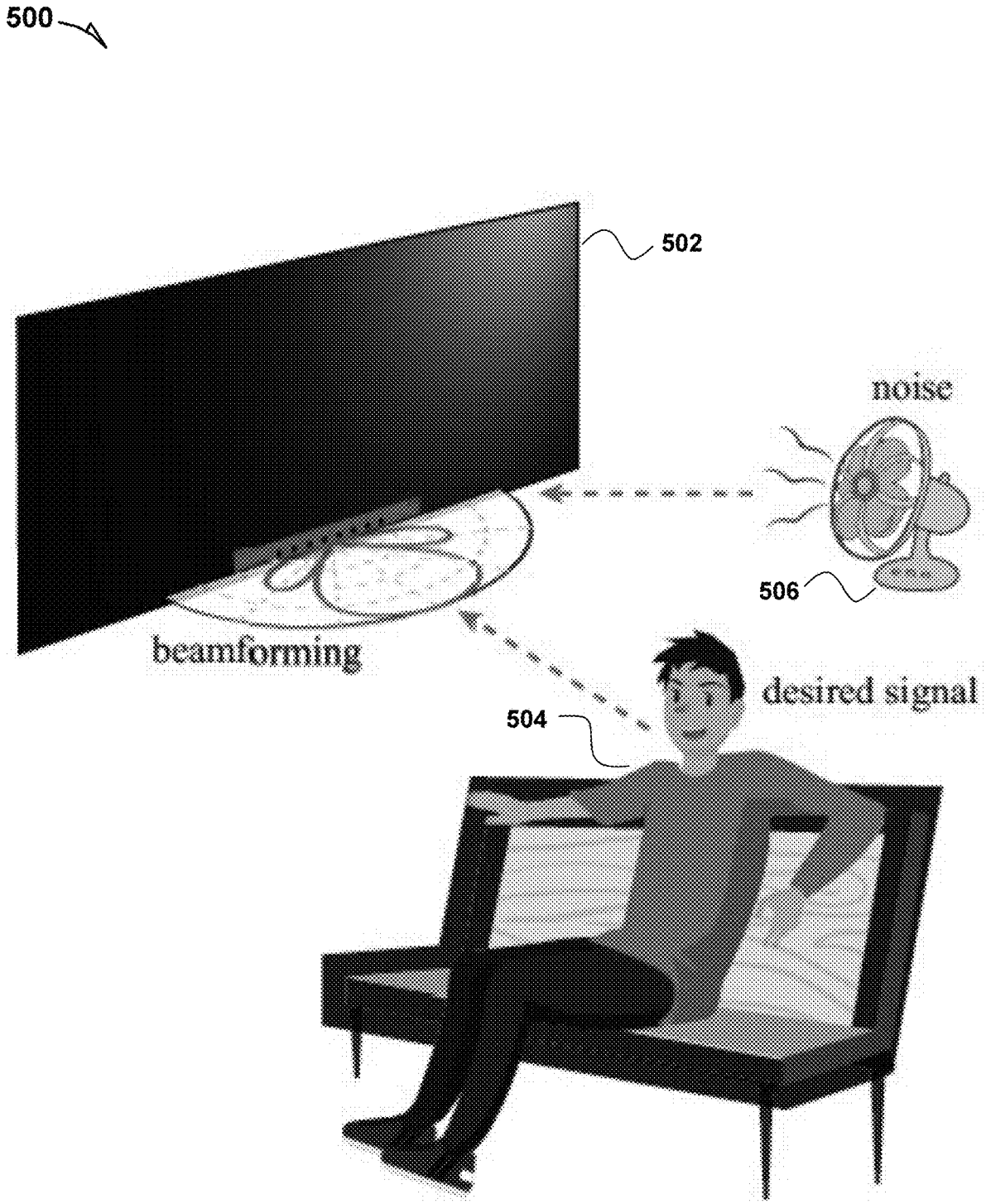
FIG. 5 shows a use case for an $N^{th}$ order LDMA with a steerable beamformer integrated into a smart television.

FIG. 5 shows a use case 500 for an $N^{th}$ order LDMA with a steerable beamformer integrated into a smart television 502, according to an implementation of the present disclosure.

An LDMA (e.g., LDMA 402 of FIG. 4) may be integrated into a smart television 502. This LDMA may be mounted across the bottom side of the front of smart TV 502 to form a beampattern along the broadside of the front of smart TV 502. In a practical application like smart TV 502 (or any other voice activated device or subsystem), beamformer steering is desired as the source position (e.g., the voice of user 504 of smart TV 502) may vary with respect to unwanted interference (e.g., noise from fan 106). LDMAs with steerable beamformers may be very useful in varied speech communication and human-machine interface systems to extract the speech signals from mobile sources of interest from unwanted noise and interference.

Simulations and Experiments

FIGS. 6A-6D show graphs 600A-600D of polynomials, $P_1(x)$, associated with target beampatterns (shown in corresponding FIGS. 7A-7D), for first order LDMAs.

A first order target polynomial function, $P_1(x)$, is shown in each of graphs 600A-600D. The dashed line is the boundary of the visible zone, and the part of the target polynomial function, $P_1(x)$, located outside of the visible zone is invisible in the corresponding target beampatterns shown in FIGS. 7A-7D described below. The values of the null ($x_1$) in each of graphs are respectively: 600A dipole, $x_1$=cos(90°); 600B hypercardioid, $x_1$=cos(120°); 600C cardioid, $x_1$=cos(180°); and 600D subcardioid, $x_1$=−1.5.

FIGS. 7A-7D show graphs 700A-700D of the target beampatterns, associated with the polynomials (shown in corresponding FIGS. 6A-6D), for the first order LDMAs.

A first order target beampattern, $B_1(\theta)$, is shown in each of graphs 700A-700D. As noted above, the part of the target polynomial function, $P_1(x)$ of FIGS. 6A-6D), located outside of the visible zone is invisible in the corresponding target beampatterns shown in FIGS. 7A-7D. The values of the null ($x_1$) in each of graphs are respectively: 700A dipole, $x_1$=cos(90°); 700B hypercardioid, $x_1$=cos(120°); 700C cardioid, $x_1$=cos(180°); and 700D subcardioid, $x_1$=−1.5.

Figure 8A:
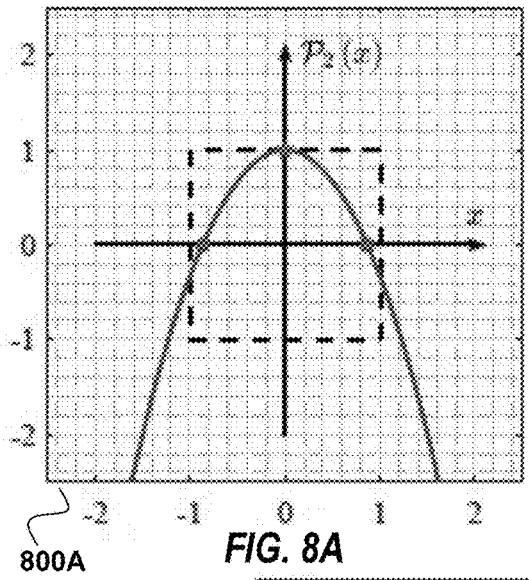
FIGS. 8A-8B show graphs of polynomials associated with target beampatterns for second order LDMAs.
Figure 8B:
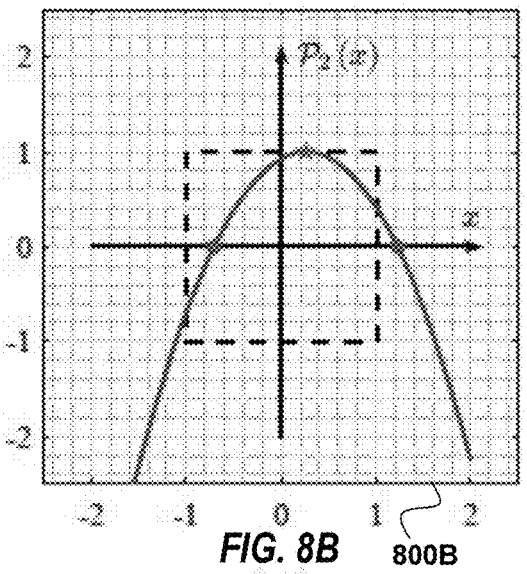

FIGS. 8A-8B show graphs 800A-800B of polynomials, $P_2(x)$, associated with target beampatterns (shown in corresponding FIGS. 9A-9B) for second order LDMAs.

A second order target polynomial function, $P_2(x)$, is shown in each of graphs 800A-800B. The polynomials, $P_2(x)$, are associated with target beampatterns for second order LDMAs, with three microphones each, where the inter element spacing, δ, is 1 cm. Two cases were considered: SLDMA-I and SLDMA-II, whose main lobes (e.g., steering angle) are at, respectively, 90° and 75°. As noted above, with respect to FIGS. 1-2, one null $x_1$ (e.g., lower order null) may be pre-specified (e.g., according to practical needs of an application of the LDMAs) and the other null $x_2$ (e.g., highest order null) may be obtained from (32) above. The coefficients of the two beamformers for SLDMA-I and SLDMA-II, respectively, are shown in Table I below.

TABLE I

COEFFICIENTS OF THE SECOND-ORDER LDMAS

| | $x_s$ | $x_1$ | $x_2$ |
|---|---|---|---|
| SLDMA-I | cos(90°) | cos(30°) | cos(150°) |
| SLDMA-II | cos(75°) | cos(135°) | 1.2247 |

Graphs 800A and 800B show that the target polynomial functions for the steerable second order LDMAs are parabolas and the nulls are symmetrically distributed on both sides of steering angle xs.

Figure 9A:
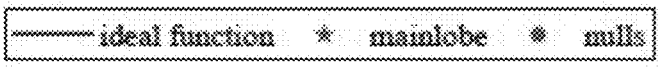
FIGS. 9A-9B show graphs of the associated target beampatterns for the second order LDMAs.
Figure 9A:
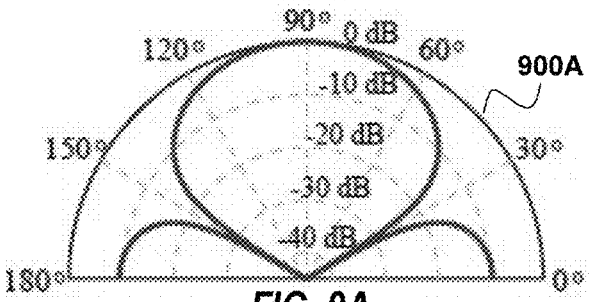
Figure 9B:
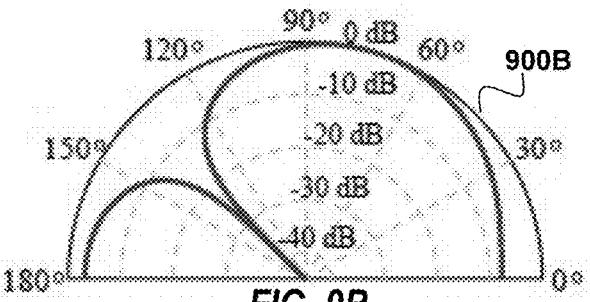

FIGS. 9A-9B show graphs 900A-900B of the associated target beampatterns for the second order LDMAs.

A second order target beampattern associated with polynomial function, $P_2(x)$, is shown in each of graphs 900A-900B. Graphs 900A and 900B show the target beampatterns at f=1 kHz.

Figure 10A:
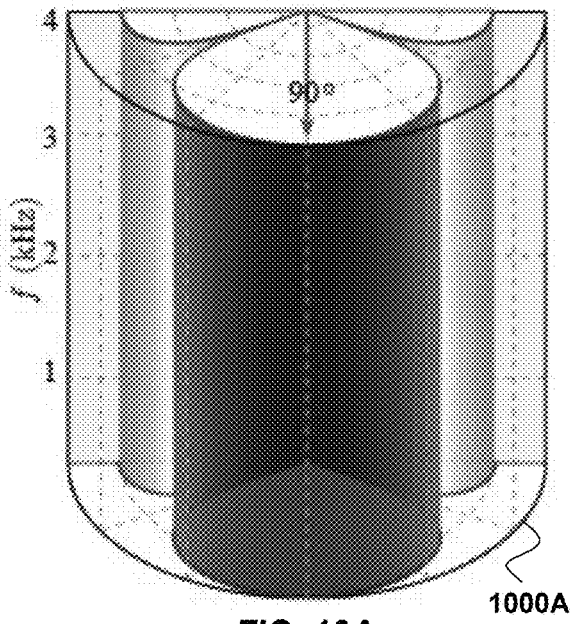
FIGS. 10A-10B show graphs of broadband beampatterns versus frequency for the second order LDMAs.
Figure 10B:
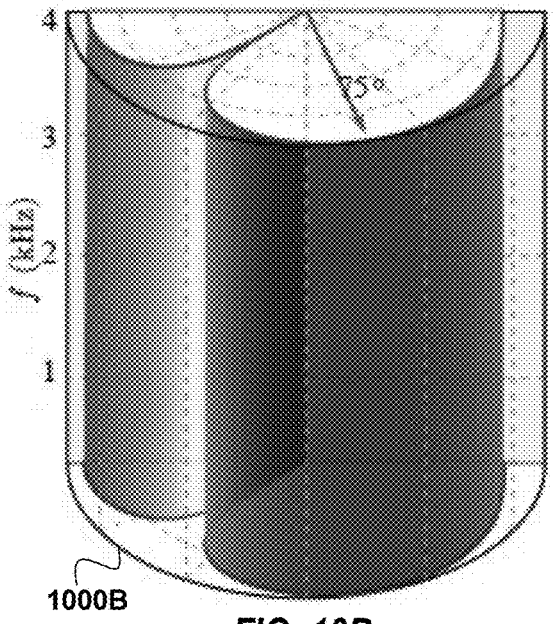

FIGS. 10A-10B show graphs 1000A-1000B of broadband beampatterns versus frequency for the second order LDMAs.

A broadband beampattern associated with polynomial function, $P_2(x)$, is shown in each of graphs 1000A-1000B. Graphs 1000A and 1000B show that the target beampatterns are frequency invariant.

Figure 11A:
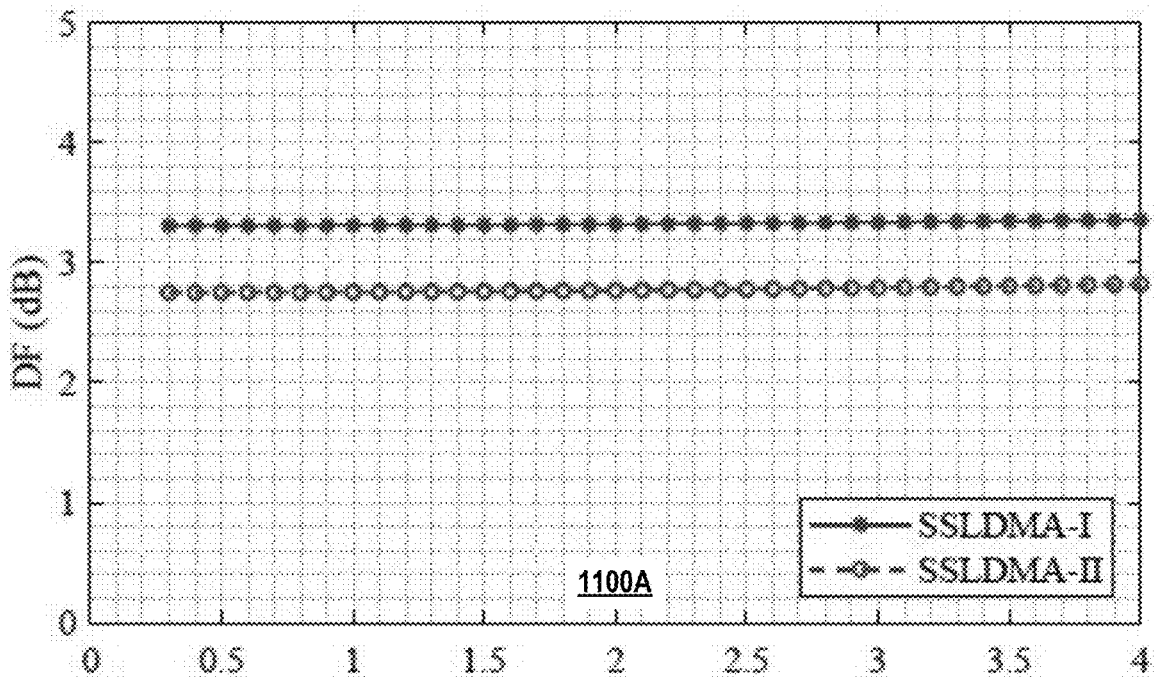
FIG. 11A shows a graph of directivity factor (DF) as a function of frequency for the second order LDMAs.

FIG. 11A shows a graph 1100A of directivity factor (DF) as a function of frequency for the second order LDMAs.

Graph 1100A shows that the DF varies with the steering angle θ. Based on graph 1100A it is clear that a second order LDMA has its maximum DF at the endfire directions (e.g., 0° and 180°)

Figure 11B:
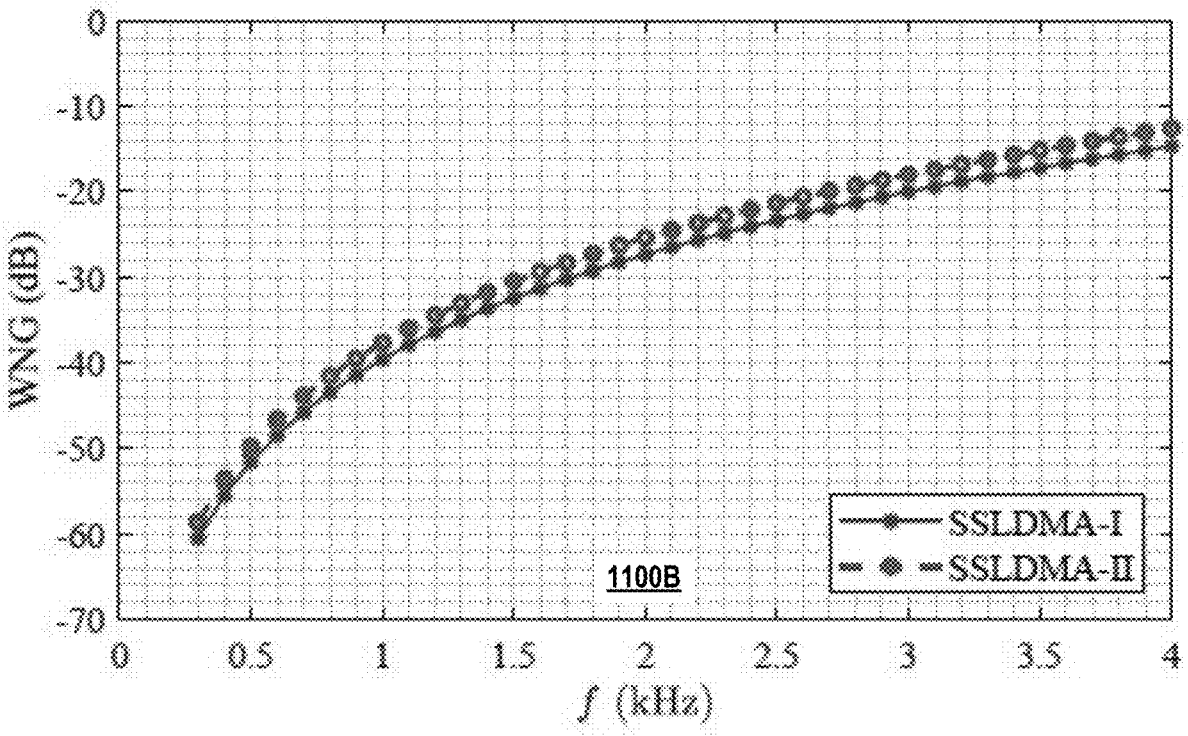
FIG. 11B shows a graph of white noise gain (WNG) as a function of frequency for the second order LDMAs.

FIG. 11B shows a graph 1100B of white noise gain (WNG) as a function of frequency for the second order LDMAs.

Graph 1100B shows that the WNG varies with the steering angle θ.

Figure 12A:
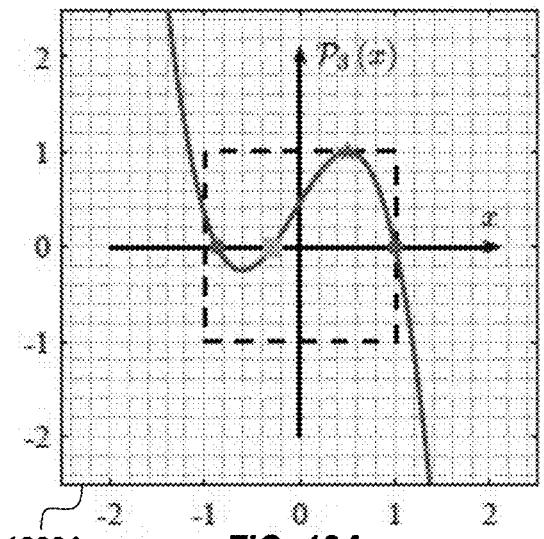
FIGS. 12A-12B show graphs of polynomials associated with target beampatterns for third order LDMAs.
Figure 12B:
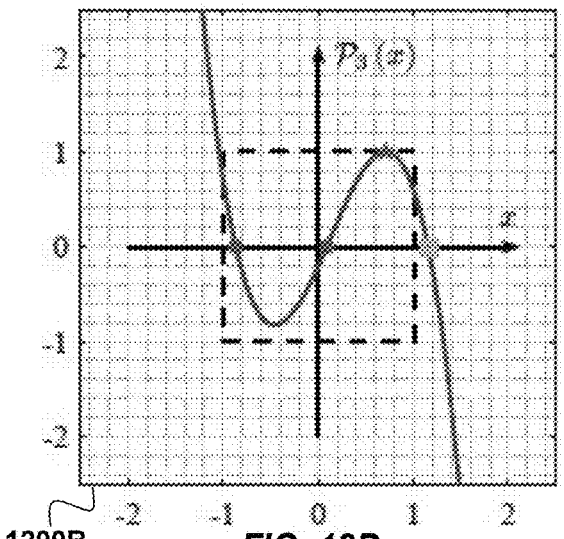

FIGS. 12A-12B show graphs 1200A-1200B of polynomials associated with target beampatterns for third order LDMAs.

A second order target polynomial function, $P_3(x)$, is shown in each of graphs 1200A-1200B. The polynomials, $P_3(x)$, are associated with target beampatterns for third order LDMAs, with four microphones each, where the inter element spacing, δ, is 1 cm. Two cases were considered: TLDMA-I and TLDMA-II, whose main lobes (e.g., steering angle) are at, respectively, 60° and 45°. As noted above, the lower order nulls $x_1$ and $x_2$ may be pre-specified (e.g., according to practical application of the LDMAs) and the other null $x_3$ (e.g., highest order null) may be obtained from (38) above. The coefficients of the two beamformers for TLDMA-I and TLDMA-II, respectively, are shown in Table II below.

TABLE II

COEFFICIENTS OF THE THIRD-ORDER LDMAS

| | $x_s$ | $x_1$ | $x_2$ | $x_3$ |
|---|---|---|---|---|
| TLDMA-I | cos(60°) | cos(0°) | cos(150°) | −0.2887 |
| TLDMA-II | cos(45°) | cos(85°) | cos(150°) | 1.1518 |

Figure 13A:
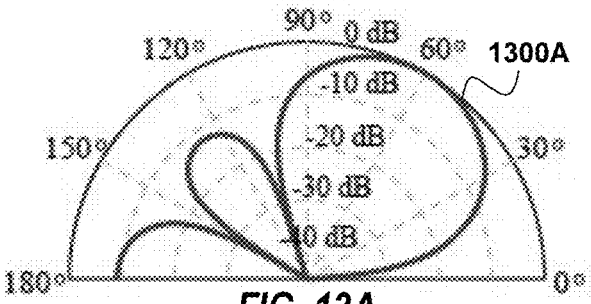
FIGS. 13A-13B show graphs of the associated target beampatterns for the third order LDMAs.
Figure 13B:
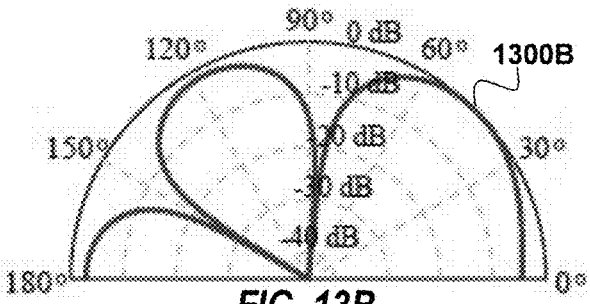

FIGS. 13A-13B show graphs 1300A-1300B of the associated target beampatterns for the third order LDMAs.

Graphs 1300A-1300B show that, compared to steerable second order LDMAs, steerable third order LDMAs have higher directivities and narrower main lobes.

Figure 14A:
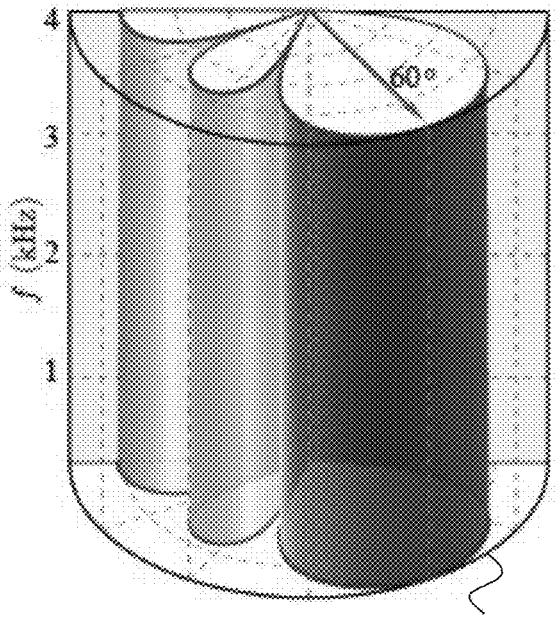
FIGS. 14A-14B show graphs of broadband beampatterns versus frequency for the third order LDMAs.
Figure 14B:
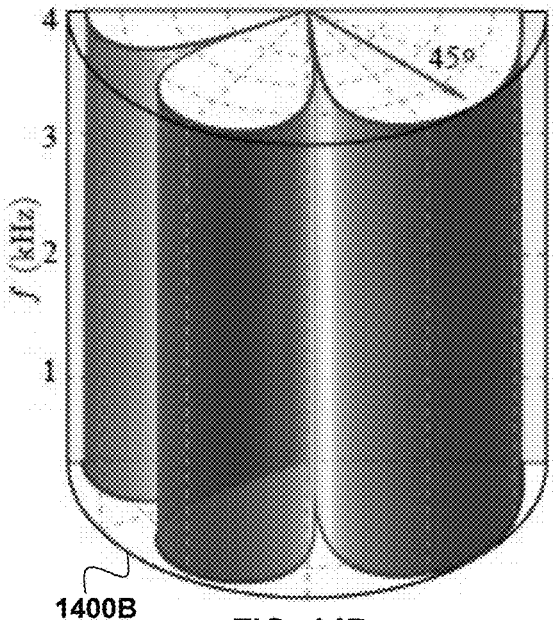

FIGS. 14A-14B show graphs 1400A-1400B of broadband beampatterns versus frequency for the third order LDMAs.

A broadband beampattern associated with polynomial function, $P_3(x)$, is shown in each of graphs 1400A-1400B. Graphs 1400A and 1400B show that the target beampatterns are frequency invariant.

Figure 15A:
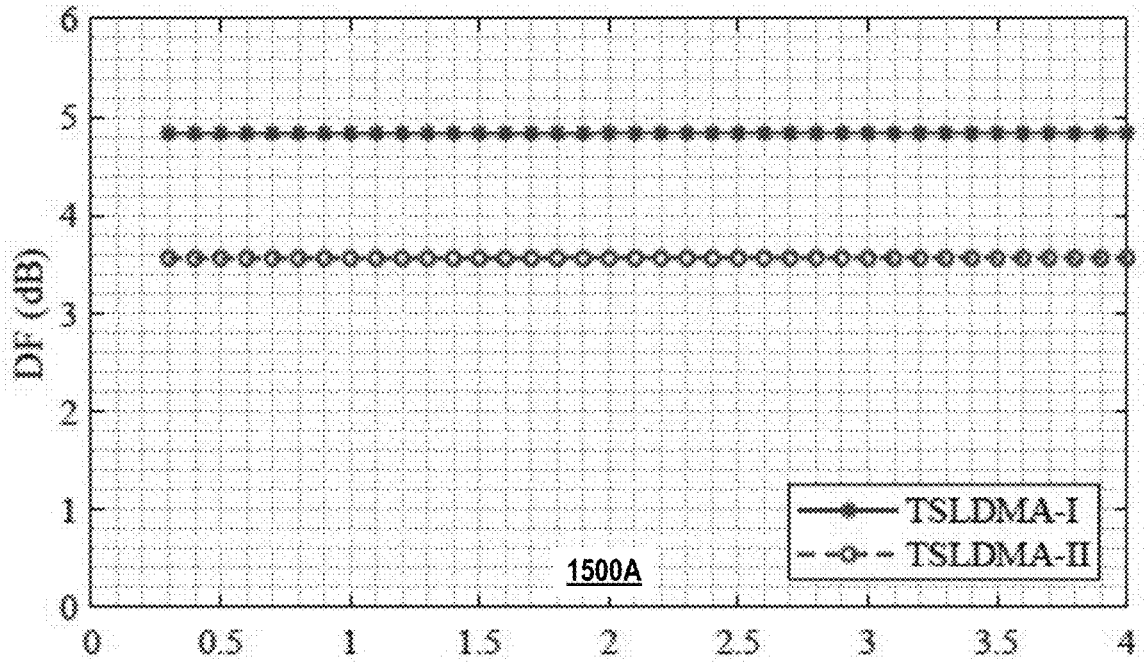
FIG. 15A shows a graph of DF as a function of frequency for the third order LDMAs.

FIG. 15A shows a graph 1500A of DF as a function of frequency for the third order LDMAs.

Graph 1500A shows that, compared to steerable second order LDMAs described above, steerable third order LDMAs have a higher DF. Generally, the DF increases with the order of the steerable LDMA.

Figure 15B:
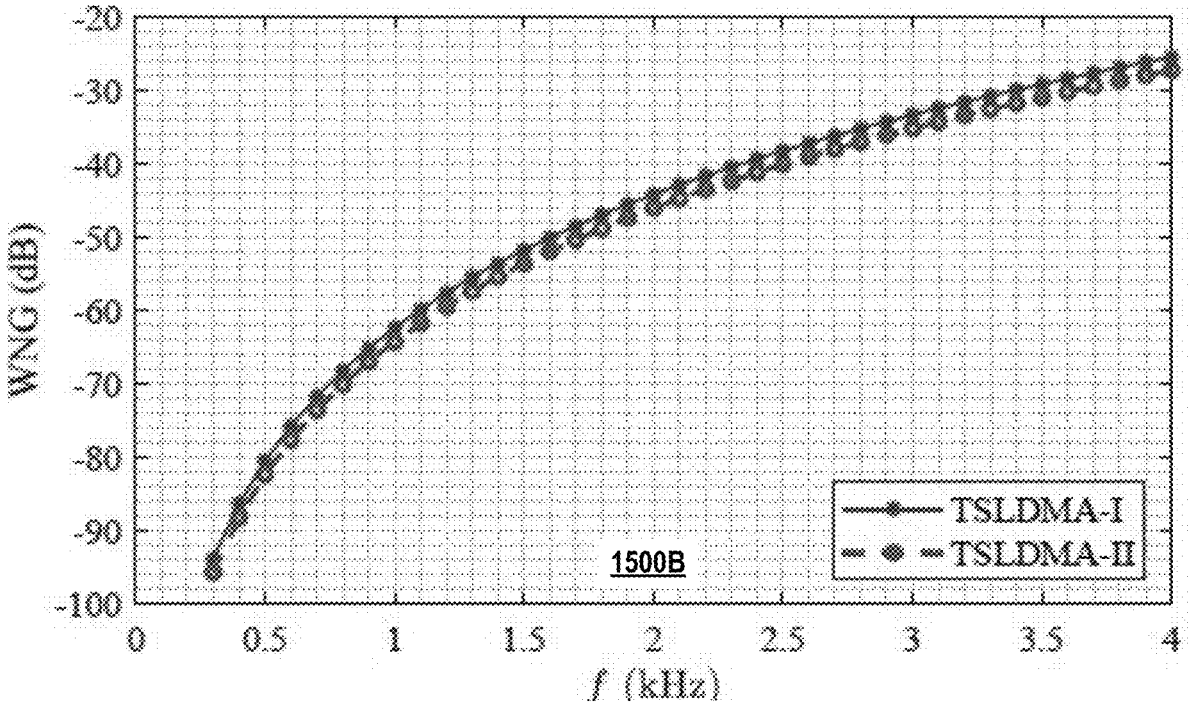
FIG. 15B shows a graph of WNG as a function of frequency for the third order LDMAs.
Figure 16A:
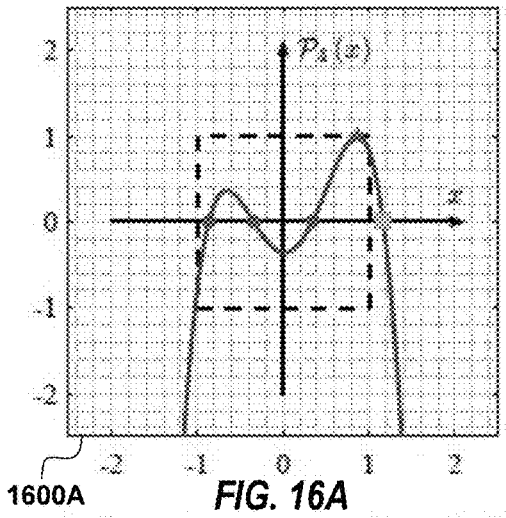
FIGS. 16A-16D show graphs of polynomials associated with target beampattern for fourth order LDMAs.
Figure 16B:
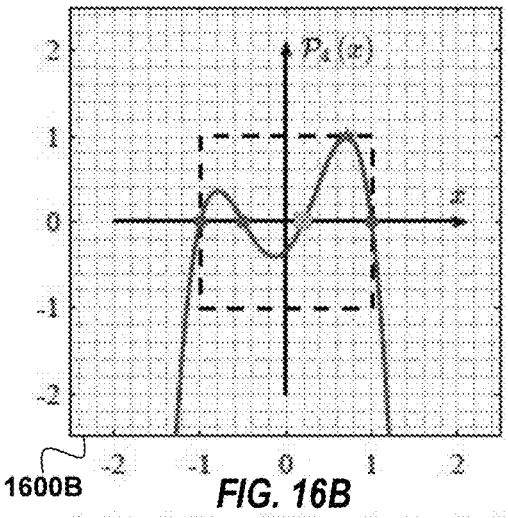
Figure 16C:
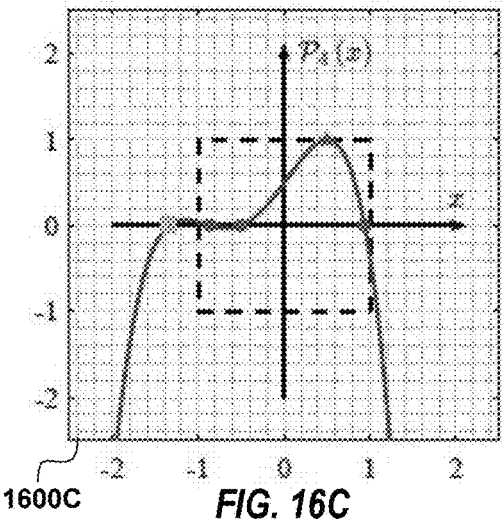
Figure 16D:
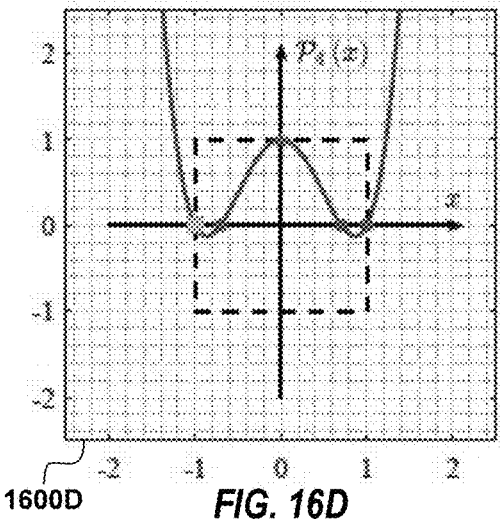
Figure 17A:
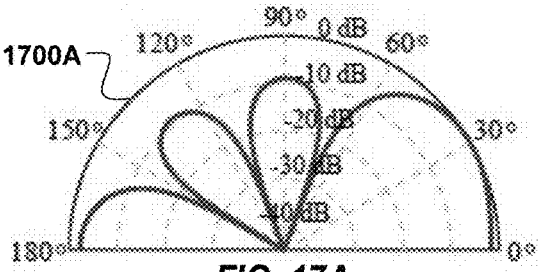
FIGS. 17A-17D show graphs of the associated target beampatterns for the fourth order LDMAs.
Figure 17B:
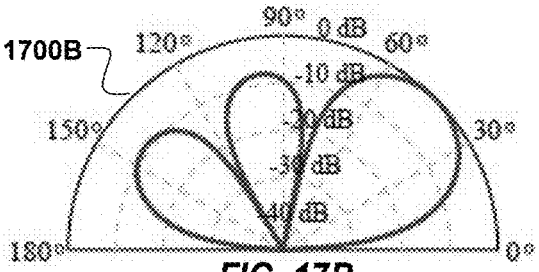
Figure 17C:
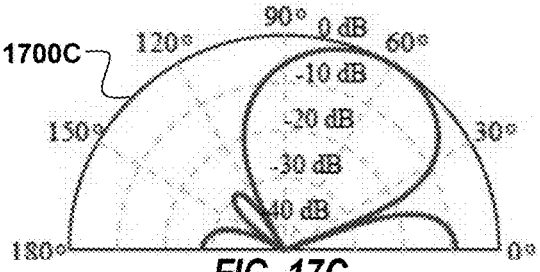
Figure 17D:
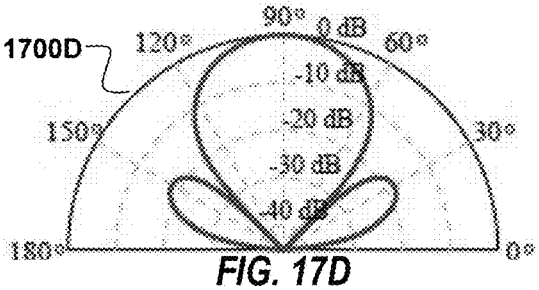
Figure 18A:
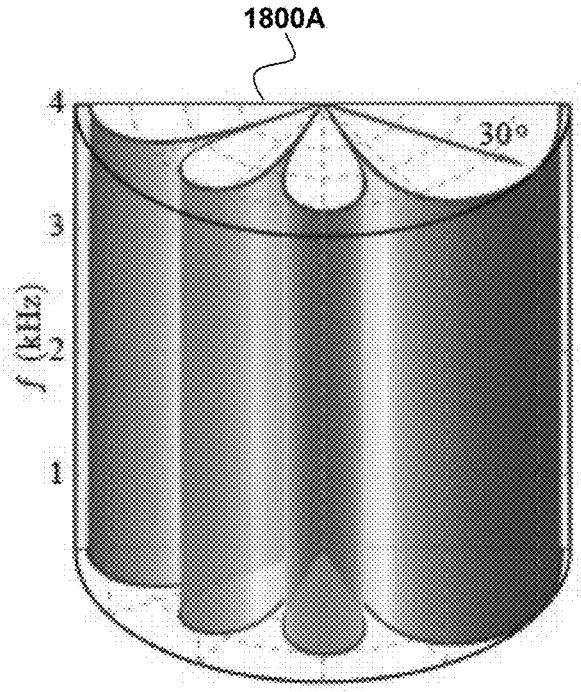
FIGS. 18A-18D show graphs of broadband beampatterns versus frequency for the fourth order LDMAs.
Figure 18B:
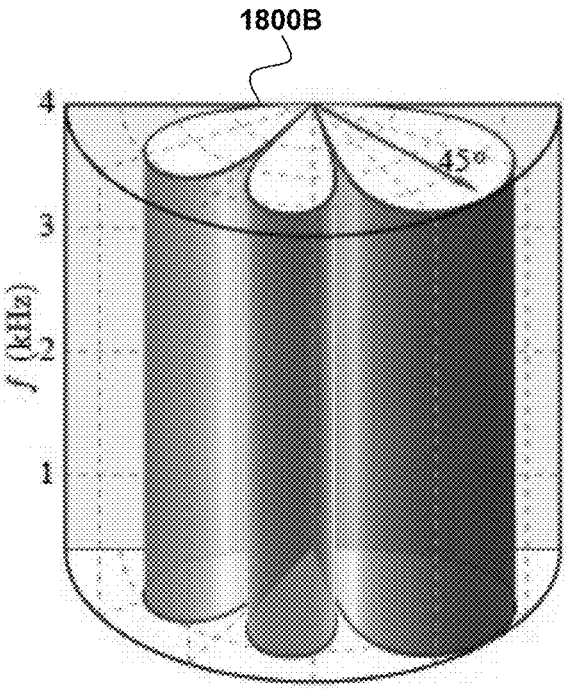
Figure 18C:
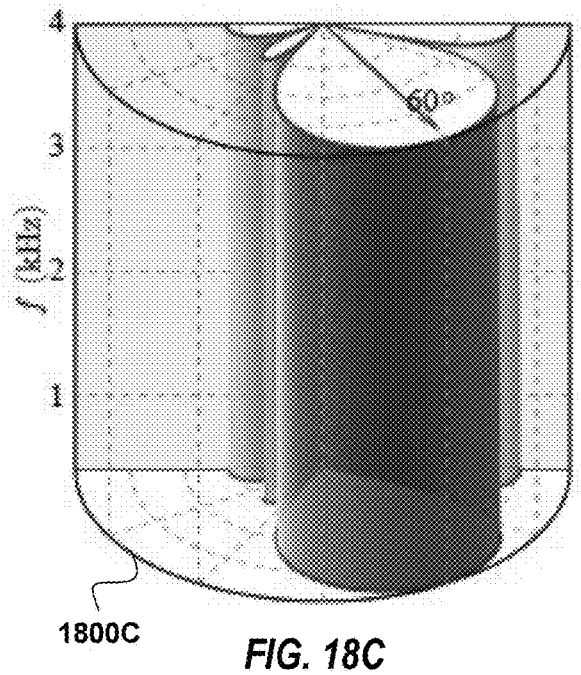
Figure 18D:
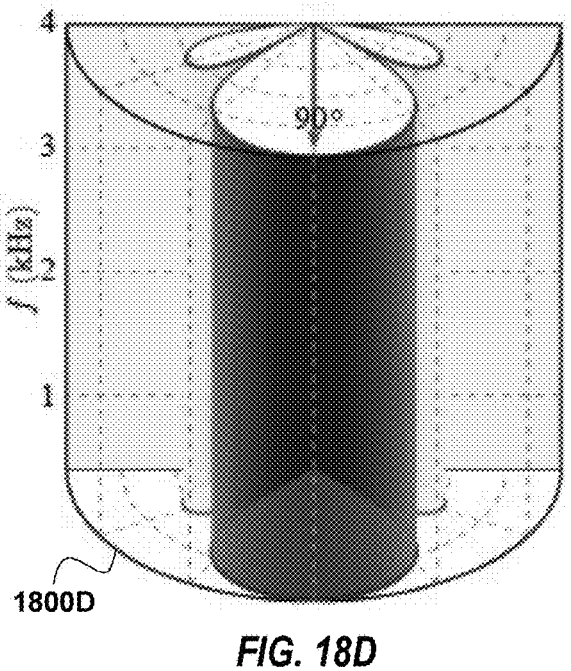

FIG. 15B shows a graph 1500B of WNG as a function of frequency for the third order LDMAs.

Graph 1500B shows that, compared to steerable second order LDMAs described above, steerable third order LDMAs have a lower WNG.

FIGS. 16A-16D show graphs 1600A-1600D of polynomials associated with target beampattern for fourth order LDMAs.

A fourth order target polynomial function, $P_4(x)$, is shown in each of graphs 1600A-1600D. The polynomials, $P_4(x)$, are associated with target beampatterns for fourth order LDMAs, with five microphones each, where the inter element spacing, δ, is 1 cm. Four cases were considered: FLDMA-I, FLDMA-II, FLDMA-III and FLDMA-IV, whose main lobes (e.g., steering angle) are at, respectively, 30°, 45°, 60° and 90°. As noted above, the lower order nulls $x_1$, $x_2$ and $x_3$ may be pre-specified (e.g., according to practical application of the LDMAs) and the coefficients vector, $a_N$, and null, $x_4$ (e.g., highest order null), may be computed according to (52) and (56), respectively. The coefficients of the four beamformers, respectively, are shown in Table III below.

TABLE III

COEFFICIENTS OF THE FOURTH ORDER LDMAS

| | $x_s$ | $x_1$ | $x_2$ | $x_3$ | $x_4$ |
|---|---|---|---|---|---|
| FLDMA-I | cos(30°) | cos(70°) | cos(110°) | cos(150°) | 1.1678 |
| FLDMA-II | cos(45°) | cos(0°) | cos(120°) | cos(180°) | 0.2071 |
| FLDMA-III | cos(60°) | cos(20°) | cos(120°) | cos(150°) | −1.3441 |
| FLDMA-IV | cos(90°) | cos(0°) | cos(45°) | cos(135°) | −1.0000 |

FIGS. 17A-17D show graphs 1700A-1700D of the associated target beampatterns for the fourth order LDMAs.

Graphs 1700A-1700D show that, compared to steerable third order LDMAs, steerable fourth order LDMAs have higher directivities and much narrower main lobes.

FIGS. 18A-18D show graphs 1800A-1800D of broadband beampatterns versus frequency for the fourth order LDMAs.

A broadband beampattern associated with polynomial function, $P_4(x)$, is shown in each of graphs 1800A-1800D. Graphs 1800A-1800D show that the target beampatterns are frequency invariant.

Figure 19A:
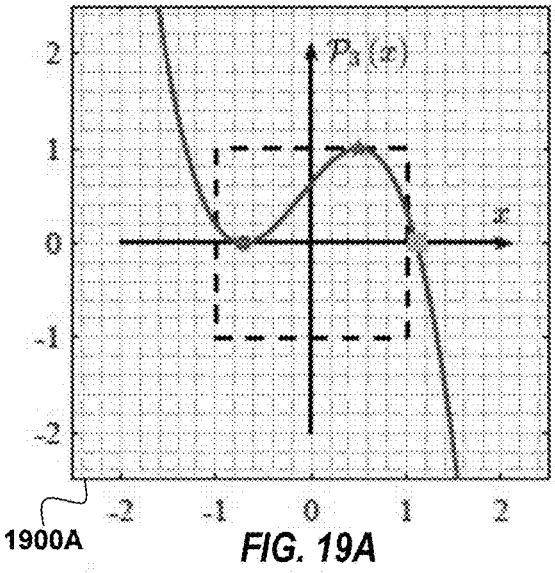
FIGS. 19A-19B show graphs 1900A-1900B of polynomials associated with target beampattern for a third order LDMA and a fourth order LDMA.
Figure 19B:
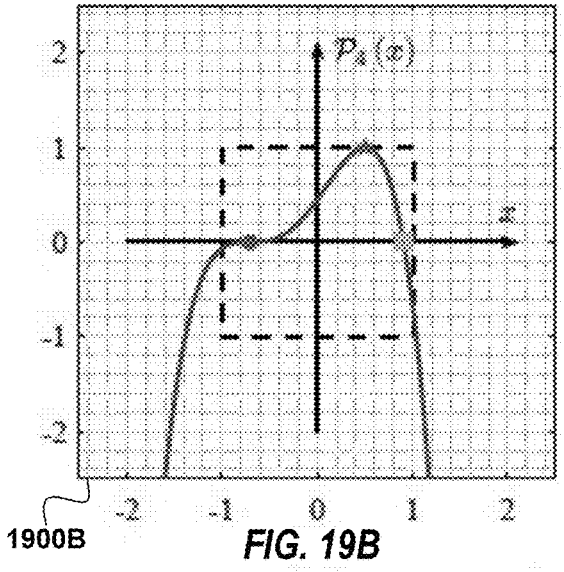

FIGS. 19A-19B show graphs 1900A-1900B of polynomials associated with target beampattern for a third order LDMA and a fourth order LDMA.

A third order target polynomial, $P_3(x)$, and a fourth order target polynomial, $P_4(x)$, are respectively shown in each of graphs 1900A and 1900B. The polynomials, $P_3(x)$ and $P_4(x)$, are associated with target beampatterns for respective third and fourth order LDMAs, with five microphones each, where the inter element spacing, δ, is 1 cm. Two cases were considered: TLDMA-III and FLDMA-V, whose main lobes (e.g., steering angle) are both at 60° and cos(135°) is a null with multiplicity. As noted above, the lower order nulls may be pre-specified (e.g., according to practical application of the LDMAs) and the coefficients vector, $a_N$, and null, $x_4$ (e.g., highest order null), may be computed according to (54 and 55) and (56) respectively. The coefficients of the two beamformers, respectively, are shown in Table IV below.

TABLE IV

COEFFICIENTS OF THE TLDMA-III AND FLDMA-V

| | $x_s$ | $x_1$ | $x_2$ | $x_3$ | $x_4$ |
|---|---|---|---|---|---|
| TLDMA-III | cos(60°) | cos(135°) | cos(135°) | 1.1036 | — |
| FLDMA-V | cos(60°) | cos(135°) | cos(135°) | cos(135°) | 0.9024 |

Figure 20A:
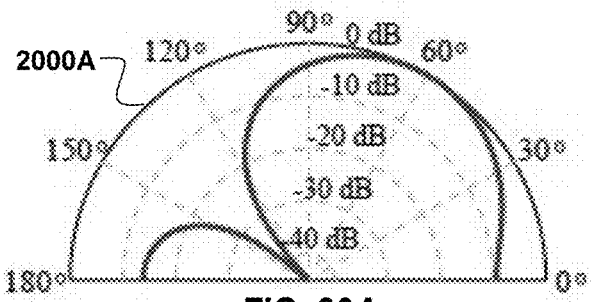
FIGS. 20A-20B show graphs of the associated target beampatterns for the third and fourth order LDMAs.
Figure 20B:
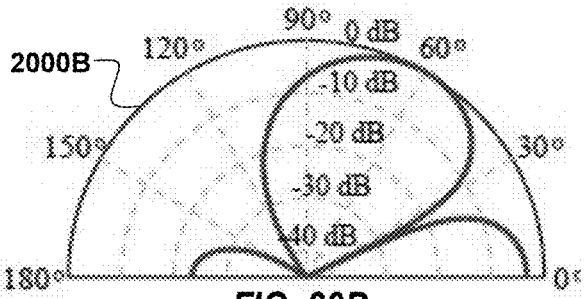

FIGS. 20A-20B show graphs 2000A-2000B of the associated target beampatterns for the third and fourth order LDMAs.

Graphs 2000A-2000B show that, compared to TLDMA-III, the FLDMA-V's null is deeper and wider.

Figure 21A:
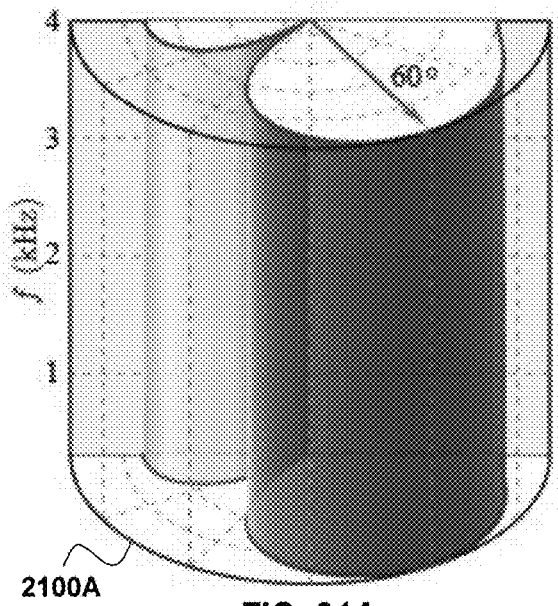
FIGS. 21A-21B show graphs of broadband beampatterns versus frequency for the third and fourth order LDMAs.
Figure 21B:
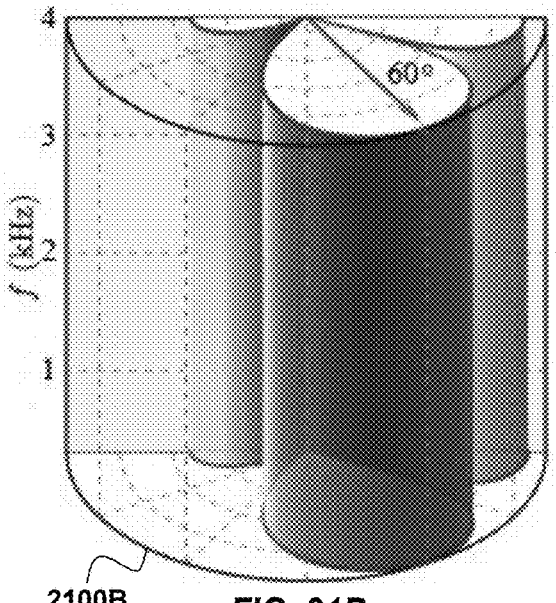
Figure 22A:
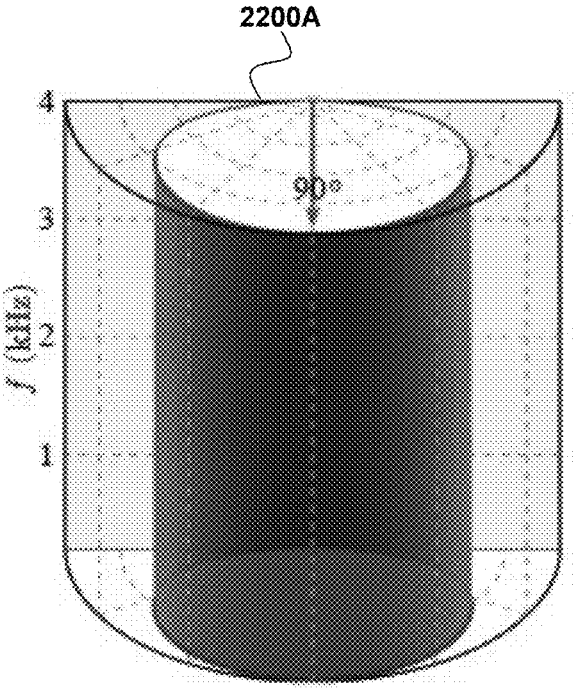
FIGS. 22A-22D show graphs of broadband beampatterns for a third order LDMA with different numbers of microphones.
Figure 22B:
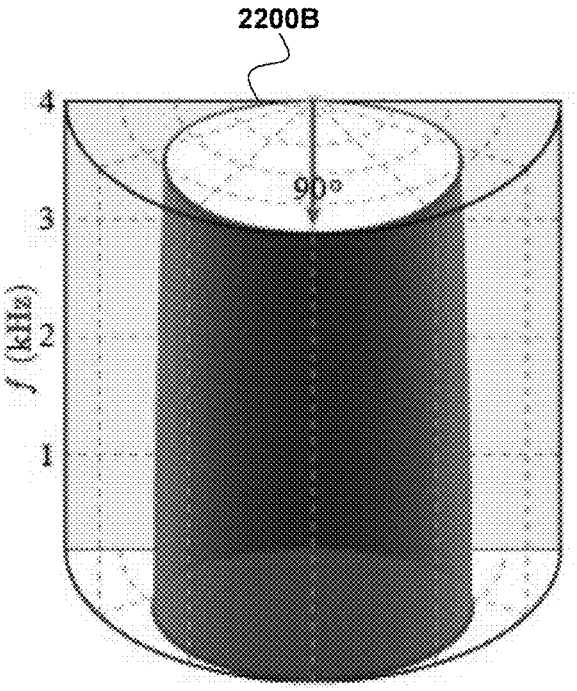
Figure 22C:
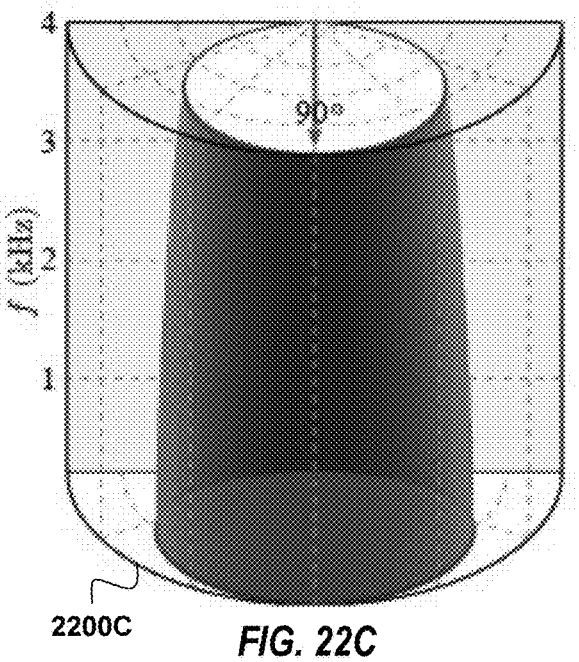
Figure 22D:
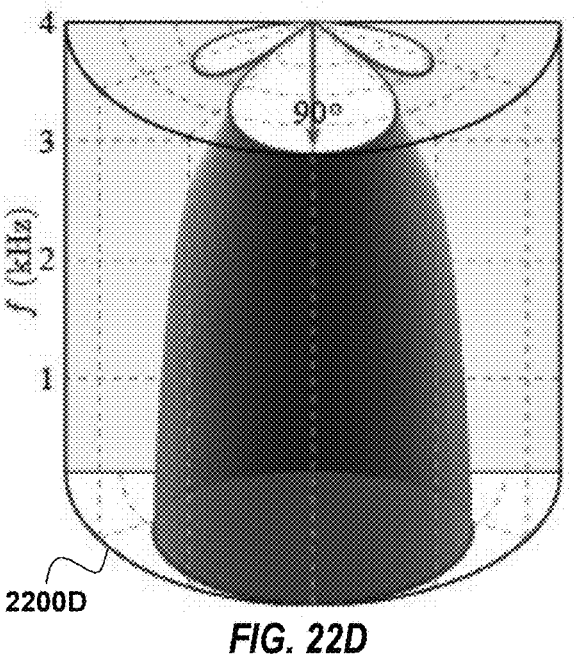

FIGS. 21A-21B show graphs 2100A-2100B of broadband beampatterns versus frequency for the third and fourth order LDMAs.

A broadband beampattern associated with polynomial function, $P_3(x)$, is shown in graphs 2100A. A broadband beampattern associated with polynomial function, $P_4(x)$, is shown in graphs 2100B. Graphs 2100A and 2100B show that the target beampatterns are frequency invariant.

FIGS. 22A-22D show graphs 2200A-220D of broadband beampatterns versus frequency for a third order LDMA with different numbers of microphones.

The WNG of a steerable LDMA may also be improved by increasing the number of microphones in the LDMA. SLDMA-III was designed with $x_s$=cos(90°), $x_1$=cos(0°), and $x_2$=cos(180°), using 3, 7, 11, and 15 microphones. Graphs 2200A and 2200B show clearly that a robust design for an LDMA (e.g., more microphones) may introduce extra nulls into the beampattern.

Figure 23A:
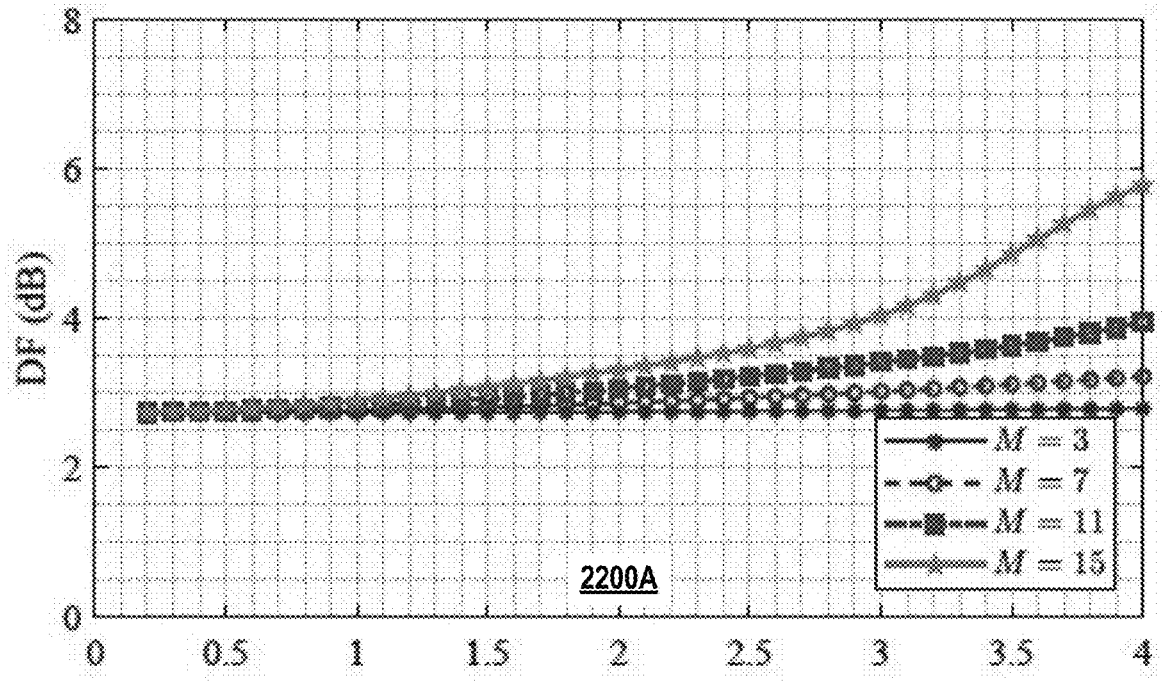
FIG. 23A shows a graph of DF as a function of frequency for the third order LDMA with different numbers of microphones.

FIG. 23A shows a graph 2300A of DF as a function of frequency for the third order LDMA with different numbers of microphones.

Graph 2300A shows that, compared to steerable LDMAs with less microphones, steerable LDMAs with more microphones may have a higher DF.

Figure 23B:
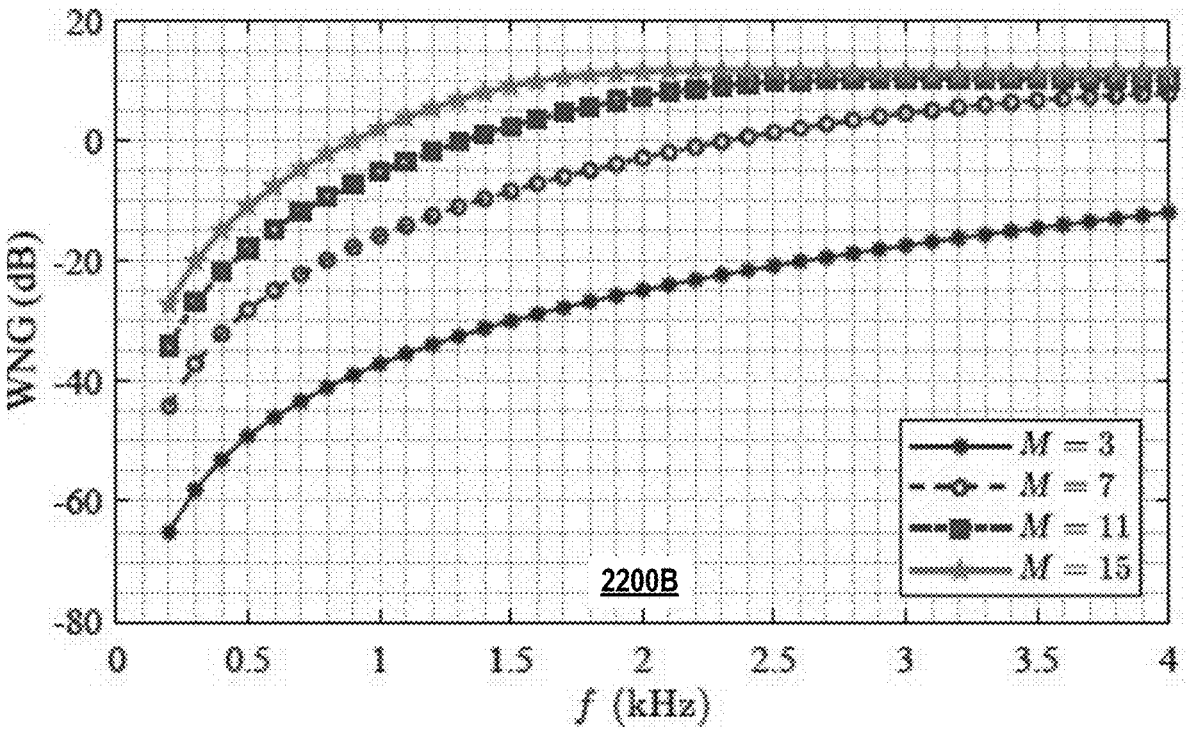
FIG. 23B shows a graph of WNG as a function of frequency for the third order LDMA with different numbers of microphones.

FIG. 23B shows a graph 2300B of WNG as a function of frequency for the third order LDMA with different numbers of microphones.

Graph 2300B shows that, compared to steerable LDMAs with less microphones, steerable LDMAs with more microphones may have a higher WNG.

Figure 24:
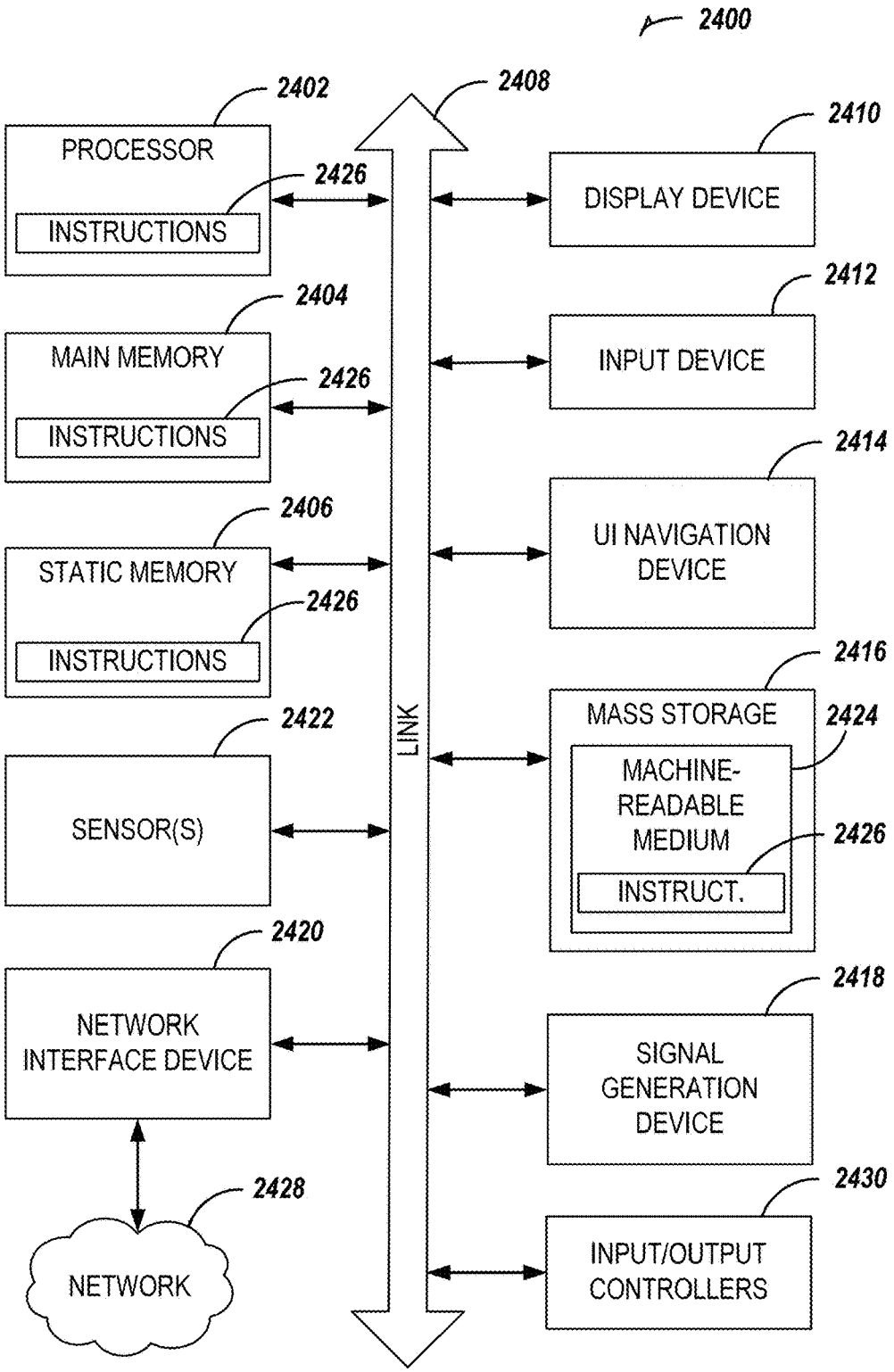
FIG. 24 is a block diagram illustrating a machine in the example form of a computer system, within which a set or sequence of instructions may be executed to cause the machine to perform any one of the methodologies discussed herein.

FIG. 24 is a block diagram illustrating a machine in the example form of a computer system 2400, within which a set or sequence of instructions may be executed to cause the machine to perform any one of the methodologies discussed herein.

In alternative implementations, the machine operates as a standalone device or may be connected (e.g., networked) to other machines. In a networked deployment, the machine may operate in the capacity of either a server or a client machine in server-client network environments, or it may act as a peer machine in peer-to-peer (or distributed) network environments. The machine may be an onboard vehicle system, wearable device, personal computer (PC), a tablet PC, a hybrid tablet, a personal digital assistant (PDA), a mobile telephone, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to individually or jointly execute instructions to perform any one or more of the methodologies discussed herein.

Example computer system 2400 includes at least one processor 2402 (e.g., a central processing unit (CPU), a graphics processing unit (GPU) or both, processor cores, compute nodes, etc.), a main memory 2404 and a static memory 2406, which communicate with each other via a link 2408 (e.g., bus). The computer system 2400 may further include a video display unit 2410, an alphanumeric input device 2412 (e.g., a keyboard), and a user interface (UI) navigation device 2414 (e.g., a mouse). In one implementation, the display device 2410, input device 2412 and UI navigation device 2414 are incorporated into a touch screen display. The computer system 2400 may additionally include a storage device 2416 (e.g., a drive unit), a signal generation device 2418 (e.g., a speaker), a network interface device 2420, and one or more sensors 2422, such as a global positioning system (GPS) sensor, compass, accelerometer, gyrometer, magnetometer, or other sensor.

The storage device 2416 includes a machine-readable medium 2424 on which is stored one or more sets of data structures and instructions 2426 (e.g., software) embodying or utilized by any one or more of the methodologies or functions described herein. The instructions 2426 may also reside, completely or at least partially, within the main memory 2404, static memory 2406, and/or within the processor 2402 during execution thereof by the computer system 2400, with the main memory 2404, static memory 2406, and the processor 2402 also constituting machine-readable media.

While the machine-readable medium 2424 is illustrated in an example implementation to be a single medium, the term "machine-readable medium" may include a single medium or multiple media (e.g., a centralized or distributed database, and/or associated caches and servers) that store the one or more instructions 2426. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. Specific examples of machine-readable media include volatile or non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 2426 may further be transmitted or received over a communications network 2428 using a transmission medium via the network interface device 2420 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Wi-Fi, 3G, and 4G LTE/LTE-A or WiMAX networks). Input/output controllers 2430 may receive input and output requests from the central processor 2402, and then send device-specific control signals to the devices they control (e.g., display device 2410). The input/output controllers 2430 may also manage the data flow to and from the computer system 2400. This may free the central processor 2402 from involvement with the details of controlling each input/output device.

Language

In the foregoing description, numerous details are set forth. It will be apparent, however, to one of ordinary skill in the art having the benefit of this disclosure, that the present disclosure may be practiced without these specific details. In some instances, well-known structures and devices are shown in block diagram form, rather than in detail, in order to avoid obscuring the present disclosure.

Some portions of the detailed description have been presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "segmenting", "analyzing", "determining", "enabling", "identifying," "modifying" or the like, refer to the actions and processes of a computer system, or similar electronic computing device, that manipulates and transforms data represented as physical (e.g., electronic) quantities within the computer system's registers and memories into other data represented as physical quantities within the computer system memories or other such information storage, transmission or display devices.

The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an implementation" or "one implementation" or "an implementation" or "one implementation" throughout is not intended to mean the same implementation or implementation unless described as such.

Reference throughout this specification to "one implementation" or "an implementation" means that a particular feature, structure, or characteristic described in connection with the implementation is included in at least one implementation. Thus, the appearances of the phrase "in one implementation" or "in an implementation" in various places throughout this specification are not necessarily all referring to the same implementation. In addition, the term "or" is intended to mean an inclusive "or" rather than an exclusive "or."

It is to be understood that the above description is intended to be illustrative, and not restrictive. Many other implementations will be apparent to those of skill in the art upon reading and understanding the above description. The scope of the disclosure should, therefore, be determined with reference to the claims, along with the full scope of equivalents to which such claims are entitled.

The invention claimed is:

1. A method for constructing an $N^{th}$ order linear differential microphone array (LDMA) with a steerable beamformer, the method comprising:

specifying, by a processing device, a target beampattern for the LDMA at a steering angle θ;

generating, by the processing device, an $N^{th}$ order polynomial associated with the target beampattern;

determining, by the processing device, a relationship between nulls of the polynomial and the steering angle θ;

determining, by the processing device, a null value based on N-1 assigned null values and the determined relationship between the nulls of the polynomial and the steering angle θ, wherein the N-1 assigned null values are associated with N-1 of the nulls of the polynomial that are of less than $N^{th}$ order and the determined null value is associated with one of the nulls that is of $N^{th}$ order; and generating, by the processing device, the steerable beamformer based on the determined null value and the N-1 assigned null values.

2. The method of claim 1, wherein N is at least two (2).

3. The method of claim 1, wherein the steerable beamformer amplifies signals impinging on the LDMA from the steering angle θ at least as much as it amplifies signals impinging on the LDMA from any other angle, for 0 E [0, 180° [.

4. The method of claim 1, wherein the polynomial comprises a function of x and x=cos 0.

5. The method of claim 4, wherein the relationship between the nulls of the polynomial and the steering angle θ is determined based on a derivative of the polynomial, at a value of x corresponding to the steering angle θ, being zero (0).

6. The method of claim 1, further comprising: assigning the values associated with the N-1 nulls of less than $N^{th}$ order based on an application of the LDMA.

7. The method of claim 6, wherein the application comprises a device configured to receive voice commands.

8. The method of claim 1, further comprising: forming a linear system of equations based on the null values, wherein the steerable beamformer is generated based on the formed linear system of equations.

9. The method of claim 1, wherein the $N^{th}$ order LDMA comprises a uniform LDMA with M microphones equally spaced along a straight line.

10. An $N^{th}$ order linear differential microphone array (LDMA) system with a steerable beamformer, the system comprising:

M microphones located on a substantially planar platform; and a processing device, communicatively coupled to the microphones, configured to:

specify a target beampattern for the LDMA at a steering angle θ;

generate an $N^{th}$ order polynomial associated with the target beampattern;

determine a relationship between nulls of the polynomial and the steering angle θ;

determine a null value based on N-1 assigned null values and the relationship between the nulls of the polynomial and the steering angle θ, wherein the N-1 assigned null values are associated with N-1 of the nulls of the polynomial that are of less than Nth order and the determined null value is associated with one of the nulls that is of Nth order; and generate the steerable beamformer based on the determined null value and the N-1 assigned null values.

11. The system of claim 10, wherein N is at least two (2).

12. The system of claim 10, wherein the steerable beamformer amplifies signals impinging on the LDMA from the steering angle θ at least as much as it amplifies signals impinging on the LDMA from any other angle, for 0 ∈.

13. The system of claim 10, wherein the polynomial comprises a function of x and x=cos 0.

14. The system of claim 13, wherein the processing device is further configured to: determine the relationship between the nulls of the polynomial and the steering angle θ based on a derivative of the polynomial, at a value of x corresponding to the steering angle θ, being zero (0).

15. The system of claim 10, wherein the processing device is further configured to: assign the values associated with the N-1 nulls that are of less than $N^{th}$ order based on an application of the LDMA.

16. The system of claim 15, wherein the application comprises a device configured to receive voice commands.

17. The system of claim 10, wherein the processing device is further configured to: form a linear system of equations based on the null values, wherein the steerable beamformer is generated based on the formed linear system of equations.

18. The system of claim 10, wherein the $N^{th}$ order LDMA comprises a uniform LDMA with the M microphones equally spaced along a straight line.

* * * * *